US009093034B2

(12) United States Patent
Moh et al.

(10) Patent No.: US 9,093,034 B2
(45) Date of Patent: Jul. 28, 2015

(54) LIQUID CRYSTAL DISPLAY AND METHOD OF DRIVING THE SAME

(71) Applicant: Samsung Display Co., Ltd., Yongin (KR)

(72) Inventors: Sang-Moon Moh, Hwaseong-si (KR); Samjin Hwang, Yongin-si (KR)

(73) Assignee: Samsung Display Co., Ltd., Yongin (KR)

( * ) Notice: Subject to any disclaimer, the term of this patent is extended or adjusted under 35 U.S.C. 154(b) by 263 days.

(21) Appl. No.: 13/732,770

(22) Filed: Jan. 2, 2013

(65) Prior Publication Data

US 2013/0257829 A1 Oct. 3, 2013

(30) Foreign Application Priority Data

Mar. 28, 2012 (KR) ..... 10-2012-0031861

(51) Int. Cl.
*G09G 3/36* (2006.01)

(52) U.S. Cl.
CPC ..... *G09G 3/36* (2013.01); *G09G 3/3614* (2013.01); *G09G 3/3648* (2013.01); *G09G 2320/0204* (2013.01)

(58) Field of Classification Search
CPC ..... G09G 3/36; G09G 3/3614; G09G 2320/0204; G09G 3/3648
USPC ..... 345/92, 50, 55, 87, 204, 90, 53, 96, 209
See application file for complete search history.

(56) References Cited

U.S. PATENT DOCUMENTS

| | | | | |
|---|---|---|---|---|
| 6,552,707 | B1 * | 4/2003 | Fujiyoshi | 345/98 |
| 7,091,946 | B2 | 8/2006 | Tsutsui et al. | |
| 7,592,992 | B2 | 9/2009 | Yi | |
| 7,710,374 | B2 | 5/2010 | Lee | |
| 2008/0001889 | A1 | 1/2008 | Chun et al. | |

FOREIGN PATENT DOCUMENTS

| | | |
|---|---|---|
| JP | 2008-511855 | 4/2004 |
| JP | 2006-330693 | 12/2006 |
| JP | 2008-268887 | 11/2008 |
| KR | 10-0656903 | 7/2001 |
| KR | 10-0848094 | 10/2003 |
| KR | 10-2006-0077952 | 7/2006 |
| KR | 10-2008-0088141 | 10/2008 |
| KR | 10-2011-0022972 | 3/2011 |

* cited by examiner

*Primary Examiner* — Kent Chang
*Assistant Examiner* — Nelson Rosario
(74) *Attorney, Agent, or Firm* — H.C. Park & Associates, PLC

(57) ABSTRACT

A liquid crystal display includes pixels arranged in areas defined by gate lines and data lines, a gate driver to drive the gate lines, a data driver to drive the data lines in response to an inversion control signal, and a timing controller to control the gate driver and the data driver in response to an image signal and a control signal from an external source. The inversion control signal carries inversion information corresponding to each of the pixels, and the inversion information is repeated at every inversion block including I by J pixels and at every K frame, I, J, and K each being a positive integer.

15 Claims, 24 Drawing Sheets

LIQUID CRYSTAL DISPLAY AND METHOD OF DRIVING THE SAME

CROSS-REFERENCE TO RELATED APPLICATION

This application claims priority from and the benefit of Korean Patent Application No. 10-2012-0031861, filed on Mar. 28, 2012, which is incorporated herein by reference for all purposes as if fully set forth herein.

BACKGROUND OF THE INVENTION

1. Field of the Invention

Exemplary embodiments of the present invention relate to a liquid crystal display and a method of driving the same. More particularly, exemplary embodiments of the present invention relate to a liquid crystal display driven in an inversion scheme and a method of driving the liquid crystal display.

2. Discussion of the Background

A liquid crystal display typically includes two substrates facing each other and a liquid crystal layer disposed between the two substrates. When voltages are applied to two electrodes respectively disposed on the two substrates, an electric field is generated in the liquid crystal layer due to an electric potential difference between the two electrodes and liquid crystal molecules in the liquid crystal layer are realigned along the electric field.

When the electric field is continuously applied to the liquid crystal layer in the same direction, electrical and physical properties of the liquid crystal layer may be degraded, and thus the direction of the electric field may need to be changed periodically. To this end, an inversion driving scheme, in which a polarity of a voltage applied to one of the two electrodes is inverted with reference to the other one of the two electrodes, is extensively used.

As the inversion driving scheme, a frame inversion driving scheme that inverts the polarity of the electrode in the unit of frame, a line inversion driving scheme that inverts the polarity of the electrode in the unit of line, and a dot inversion driving scheme that inverts the polarity of the electrode in the unit of pixel are suggested. However, due to the inversion driving scheme, various defects, such as horizontal or vertical line defect, crosstalk, greenish, etc., still remain.

SUMMARY OF THE INVENTION

Exemplary embodiments of the present invention provide a liquid crystal display capable of reducing a display defect using an inversion driving scheme.

Exemplary embodiments of the present invention provide a method of driving the liquid crystal display using the inversion driving scheme.

Additional features of the invention will be set forth in the description which follows, and in part will be apparent from the description, or may be learned by practice of the invention.

An exemplary embodiments of the present invention discloses a liquid crystal display that includes a plurality of pixels arranged in areas defined by a plurality of gate lines and a plurality of data lines, a gate driver to drive the gate lines, a data driver to drive the data lines in response to an inversion control signal, and a timing controller to control the gate driver and the data driver in response to an image signal and a control signal from an external source. The inversion control signal carries inversion information corresponding to each of the pixels, and the inversion information is repeated at every inversion block including I by J pixels and at every K frame, I, J, and K each being a positive integer.

Another exemplary embodiment of the present invention discloses a method of driving a liquid crystal display including a plurality of pixels arranged in areas defined by a plurality of gate lines and a plurality of data lines. The method includes receiving an image signal and a control signal to output a data signal and an inversion control signal, and outputting a data driving voltage to drive the data lines in response to the data signal and the inversion control signal. The inversion control signal carries inversion information corresponding to each of the pixels, and the inversion information is repeated at every inversion block including I by J pixels and at every K frame, I, J, and K each being a positive integer.

According to the above, since the liquid crystal display is operated in the scattering inversion driving scheme, the display defects appearing on the display panel may be reduced, thereby improving the display quality of the liquid crystal display.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
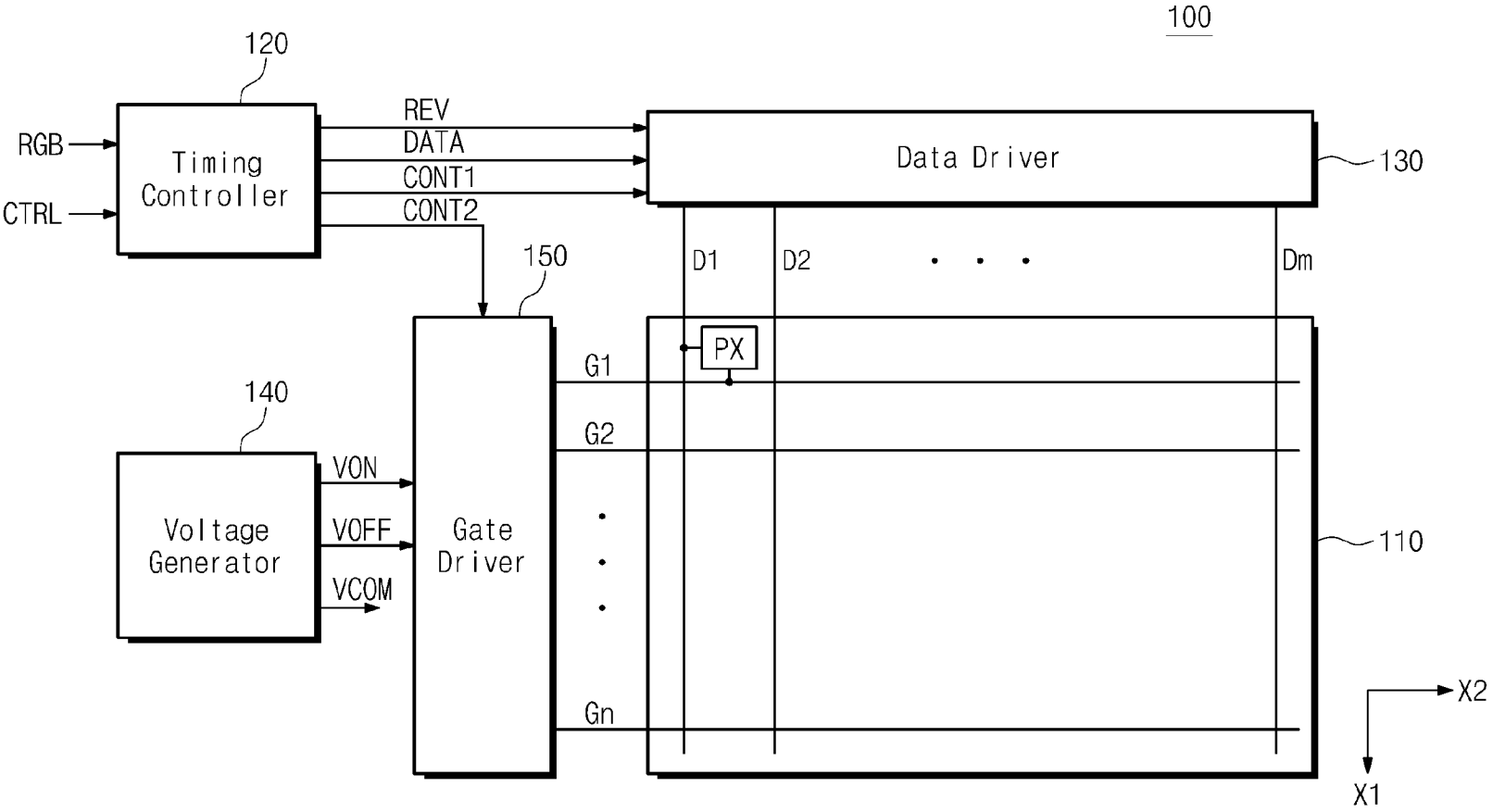
FIG. 1 is a block diagram showing a liquid crystal display according to an exemplary embodiment of the present invention.

The present invention will be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art.

In the drawings, the thickness of layers, films, panels, regions, etc., may be exaggerated for clarity. It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. In contrast, It will be understood that when an element such as a layer, film, region, or substrate is referred to as being "beneath" another element, it can be directly beneath the other element or intervening elements may also be present. Meanwhile, when an element is referred to as being "directly beneath" another element, there are no intervening elements present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

Hereinafter, exemplary embodiments of the present invention will be explained in detail with reference to the accompanying drawings.

FIG. 1 is a block diagram showing a liquid crystal display according to an exemplary embodiment of the present invention.

Referring to FIG. 1, a liquid crystal display 100 includes a display panel 110, a timing controller 120, a data driver 130, a voltage generator 140, and a gate driver 150.

The display panel 110 includes a plurality of data lines D1 to Dm extending in a first direction X1, a plurality of gate lines G1 to Gn extending in a second direction X2 crossing the first direction X1, and a plurality of pixels PX arranged in areas defined by the data lines D1 to Dm and the gate lines G1 to Gn in a matrix form. The data lines D1 to Dm are insulated from the gate lines G1 to Gn.

Although not shown in FIG. 1, each pixel PX includes a switching transistor connected to a corresponding data line of the data lines D1 to Dm and a corresponding gate line of the gate lines G1 to Gn, a liquid crystal capacitor connected to the switching transistor, and a storage capacitor connected to the switching transistor.

The timing controller 120 receives an image signal RGB and control signals CTRL, such as a vertical synchronization signal Vsync, a horizontal synchronization signal Hsync, a main clock signal MCLK, a data enable signal DE, etc., from external sources. The timing controller 120 processes the image signal RGB on the basis of the control signals CTRL and applies an inversion control signal REV, a data signal DATA, and a first control signal CONT1 to the data driver 130 and a second control signal CONT2 to the gate driver 150. The first control signal CONT1 includes a horizontal synchronization start signal STH, a clock signal HCLK, and a line latch signal TP, and the second control signal CONT2 includes a vertical synchronization start signal STV1, an output enable signal OE, and first and second gate pulse signals CPV1 and CPV2.

The data driver 130 outputs gray-scale voltages in response to the inversion control signal REV, the data signal DATA, and the first control signal CONT1 to drive the data lines D1 to Dm.

The voltage generator 140 outputs first and second gate-on voltages VON1 and VON2, a gate-off voltage VOFF, and a common voltage VCOM in response to first and second kick-back signals KB1 and KB2 and a voltage level signal VD.

Responsive to the second control signal CONT2 from the timing controller 120 and first and second clock signals CKV1 and CKV2 and the voltage level signal VD from the voltage generator 140, the gate driver 150 drives the gate lines G1 to Gn. The gate driver 150 includes a gate driver IC. In recent, the gate driver IC is configured to include an amorphous silicon gate circuit using an amorphous silicon thin film transistor (a-Si).

When the gate-on voltage VON is applied to one gate line by the gate driver 150, switching transistors connected to the one gate line and arranged in the same row are turned on. The data driver 130 applies the gray-scale voltages corresponding to the data signal DATA to the data lines D1 to Dm. The gray-scale voltages applied to the data lines D1 to Dm are provided to the pixels through the turned-on switching transistors. Here, a period in which the switching transistors arranged in one row are turned on, i.e., one period of the data enable signal DE is called "one horizontal period" or "1H".

Figure 2:
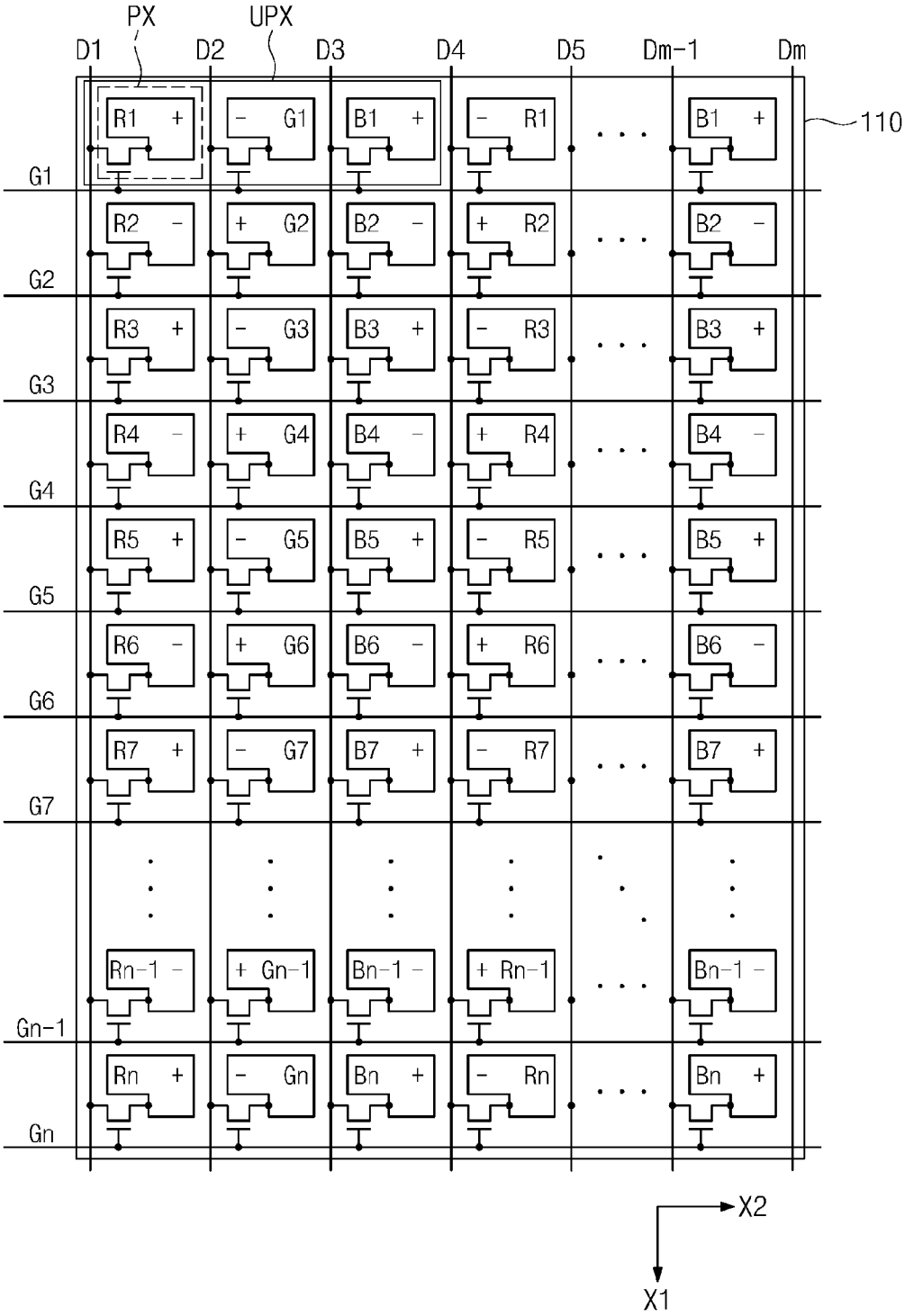
FIG. 2 is a view showing an arrangement of pixels in a display panel shown in FIG. 1.

FIG. 2 is a view showing an arrangement of pixels in a display panel shown in FIG. 1.

Referring to FIG. 2, each pixel of the display panel 110 includes one of red, green, and blue pixel electrodes and one switching transistor. For instance, the pixel PX includes the red pixel electrode R1 and the switching transistor. A unit pixel includes the red, green, and blue pixel electrodes and the switching transistors connected to the red, green, and blue pixels in one-to-one correspondence. For example, the unit pixel UPX includes the pixel electrodes R1, G1, and B1 and the switching transistors respectively connected to the pixel electrodes R1, G1, and B1.

Each switching transistor is connected to the corresponding gate line of the gate lines G1 to Gn and the corresponding data line of the data lines D1 to Dm. The pixel electrodes R1, G1, and B1 are sequentially arranged in the second direction X2 in which the gate lines G1 to Gn extend, and the pixel electrodes having the same color are arranged in the same column along the first direction X1 in which the data lines D1 to Dm extend. For instance, the red pixel electrodes R1 to Rn are arranged at the right side of the data line D1, the green pixel electrodes G1 to Gn are arranged at the right side of the data line D2, and the blue pixel electrodes B1 to Bn are arranged at the right side of the data line D3. In the present exemplary embodiment, the pixel electrodes are arranged in the order of red, green, and blue pixel electrodes in the second direction X2, but they should not be limited thereto or thereby. That is, the arrangement order of the pixel electrodes may be modified, e.g., (R, B, G), (G, B, R), (G, R, B), (B, R, G), (B, G, R), etc.

Figure 3:
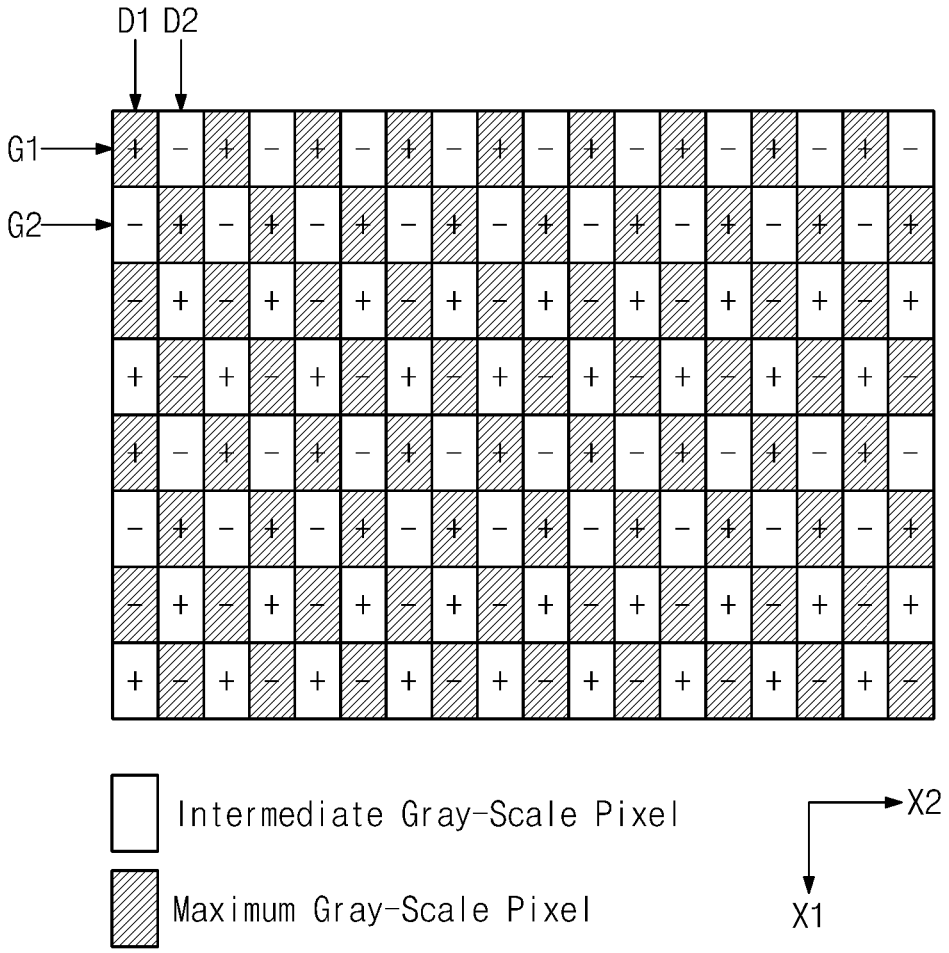
FIG. 3 is a view explaining an inversion driving scheme of an exemplary embodiment of the display panel shown in FIG. 2.

FIG. 3 is a view explaining an inversion driving scheme of an exemplary embodiment of the display panel shown in FIG. 2.

Referring to FIG. 3, in case of a one-by-two inversion driving scheme, the polarity of the pixels arranged in the second direction X2 is inverted at every pixel, i.e., from positive (+) polarity to negative (−) polarity and vice versa, and the polarity of the pixels arranged in the first direction X1 is inverted at every two pixels. In the one-by-two inversion driving scheme, one-dot checker pattern appears on the display panel 110, a maximum gray-scale voltage and an intermediate gray-scale voltage are alternately applied to the pixels arranged in the first direction X1 and the second direction X2. In a case that the liquid crystal display 100 is operated in a normally white mode, the pixels applied with the maximum gray-scale voltage display black images.

Figure 4:
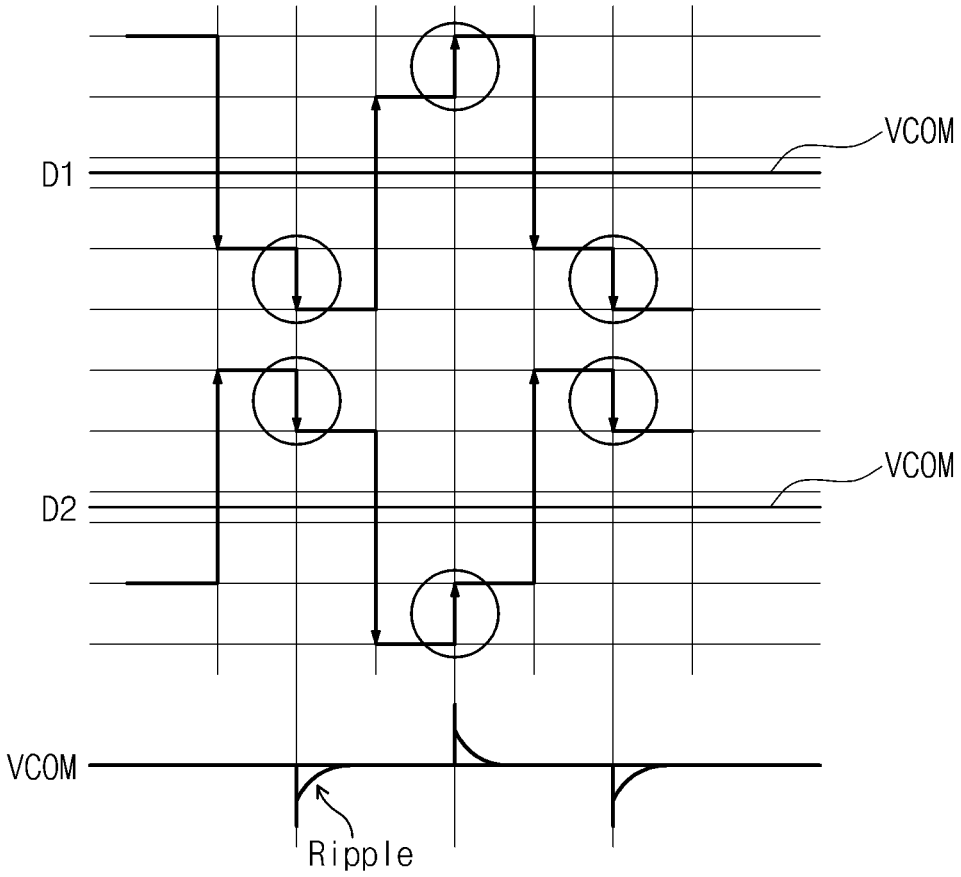
FIG. 4 is a timing diagram showing a ripple of a common voltage when the display panel shown in FIG. 3 is inversion-driven.

FIG. 4 is a timing diagram showing a ripple of a common voltage when the display panel shown in FIG. 3 is inversion-driven.

Referring to FIG. 3 and FIG. 4, since the polarity of the pixels arranged in the first direction X1 is inverted at every two pixels in the case of the one-by-two inversion driving scheme, the pixels connected to the data line D1 are sequentially operated with the polarities of +, −, −, +, +, −, −, +, +, . . . , etc., from the top of the display panel 110. In addition, the pixels connected to the data line D2 adjacent to the data line D1 are sequentially operated with the polarities of −, +, +, −, −, +, +, −, −, . . . , etc., from the top of the display panel 110.

When the one-dot checker pattern as shown in FIG. 3 is displayed on the display panel 110, the gray-scale voltages that respectively drive the data lines D1 and D2 adjacent to each other may be substantially simultaneously increased or decreased. In this case, the common voltage VCOM adjacent to the data lines D1 and D2 may be distorted by a coupling capacitance. The distortion of the common voltage VCOM causes a horizontal crosstalk or a greenish phenomenon. Those defects occur on the display panel 110 not only in the case of the one-by-two inversion driving scheme but also in the case of one-dot inversion scheme.

FIG. 5, FIG. 6, FIG. 7, and FIG. 8 are views showing various inversion driving schemes of the display panel shown in FIG. 2 according to exemplary embodiments of the present invention. FIG. 5, FIG. 6, FIG. 7, and FIG. 8 show an example of the inversion driving scheme during a K-th frame to (K+4)-th frame. In addition, the display panel 110 shown in FIG. 5, FIG. 6, FIG. 7, and FIG. includes 18 by 12 pixels, but the number of the pixels arranged in the display panel 110 should not be limited thereto or thereby.

Figure 5:
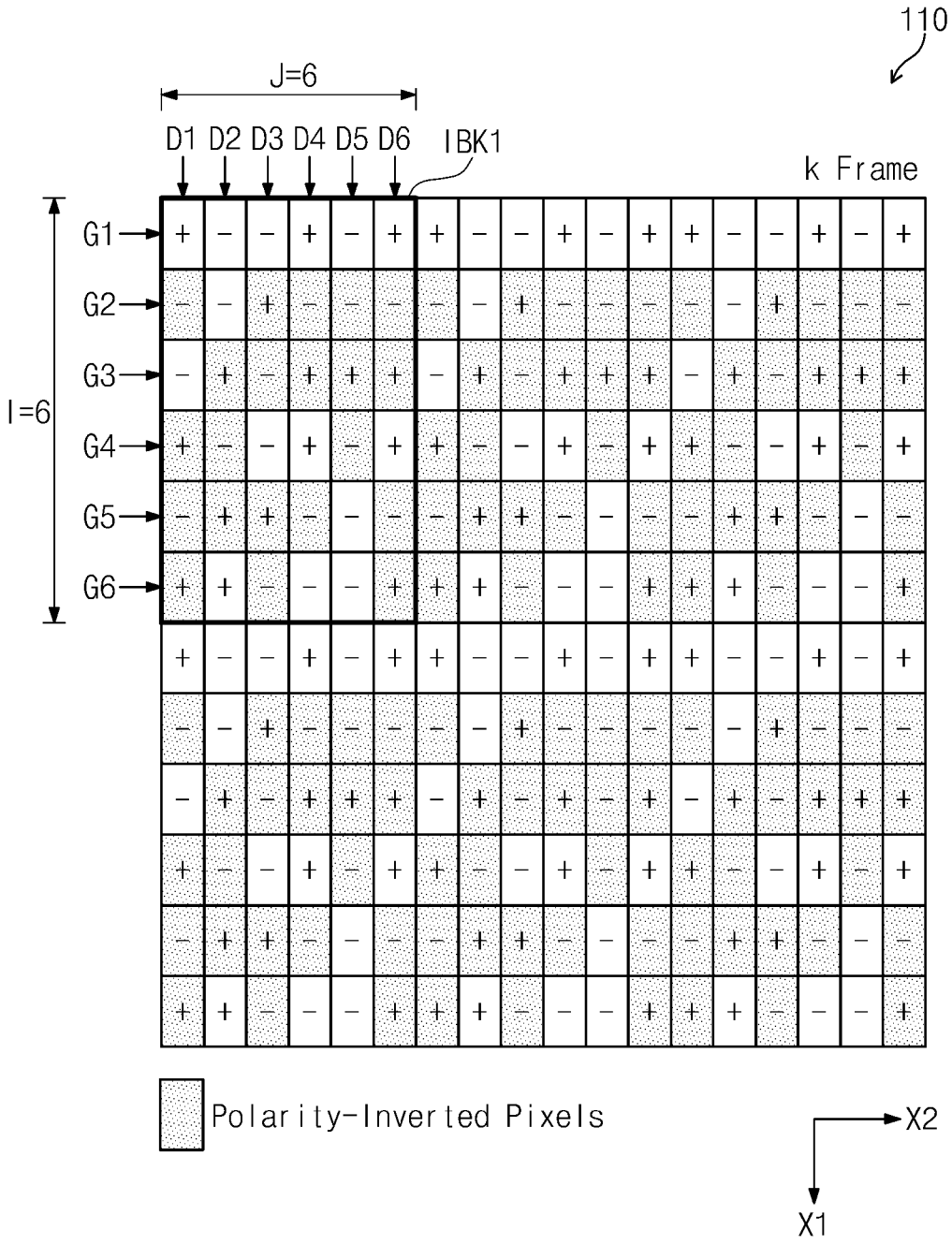
FIGS. 5 to 8 are views showing various inversion driving schemes of the display panel shown in FIG. 2 according to exemplary embodiments of the present invention.

Referring to FIG. 5, in the K-th frame, I pixels arranged in the first direction X1 are randomly operated in the positive (+) or negative (−) polarity. Likewise, J pixels arranged in the second direction X2 are randomly operated in the positive (+) or negative (−) polarity. In the present exemplary embodiment, I and J may be 6, but I and J should not be limited to 6. That is, I and J may be various positive integers.

Hereinafter, the I pixels sequentially arranged in the first direction X1 and the J pixels sequentially arranged in the second direction X2, i.e., I×J pixels are referred to as an inversion block IBK1. The polarity inversion pattern of the pixels in the inversion block IBK1 is repeated in the first direction X1 at every I pixels and in the second direction X2 at every J pixels. For instance, the pixels connected to the data line D1 are operated with the polarities of +, −, −, +, −, and + in the unit of the I pixels along the first direction X1, the pixels connected to the data line D2 are operated with the polarities of −, −, +, −, +, and + in the unit of the I pixels along the first direction X1, the pixels connected to the data line D3 are operated with the polarities of −, +, −, −, +, and − in the unit of the I pixels along the first direction X1, the pixels connected to the data line D4 are operated with the polarities of +, −, +, +, −, and − in the unit of the I pixels along the first direction X1, the pixels connected to the data line D5 are operated with the polarities of −, −, +, −, −, and − in the unit of the I pixels along the first direction X1, and the pixels connected to the data line D6 are operated with the polarities of +, −, +, +, −, and + in the unit of the I pixels along the first direction X1.

The pixels connected to the gate line G1 are operated with the polarities of +, −, −, +, −, and + in the unit of the J pixels along the second direction X2, the pixels connected to the gate line G2 are operated with the polarities of −, −, +, −, −, and − in the unit of the J pixels along the second direction X2, the pixels connected to the gate line G3 are operated with the polarities of −, +, −, +, +, and + in the unit of the J pixels along the second direction X2, the pixels connected to the gate line G4 are operated with the polarities of +, −, −, +, −, and + in the unit of the J pixels along the second direction X2, the pixels connected to the gate line G5 are operated with the polarities of −, +, +, −, −, and − in the unit of the J pixels along the second direction X2, and the pixels connected to the gate line G6 are operated with the polarities of +, +, −, −, −, and + in the unit of the J pixels along the second direction X2. As the above-described manner, the polarities of m by n pixels connected to the data lines D1 to Dm and the gate lines G1 to Gn shown in FIG. 1 may be determined.

Referring back to FIG. 5, a display defect caused by the inversion driving scheme frequently occurs when the gray-scale voltage used to drive one data line is transited to the negative polarity from the positive polarity and vice versa.

In FIG. 5, among the pixels connected to the same data line, the pixels (hereinafter, referred to as polarity-inverted pixels), each having a polarity different from that of a previous pixel, are represented in shade. As shown in FIG. 5, the polarity-inverted pixels are substantially randomly positioned. That is, the polarity-inversion between the pixels adjacent to each other is random, and thus the ripple of the common voltage VCOM may be reduced.

Figure 6:
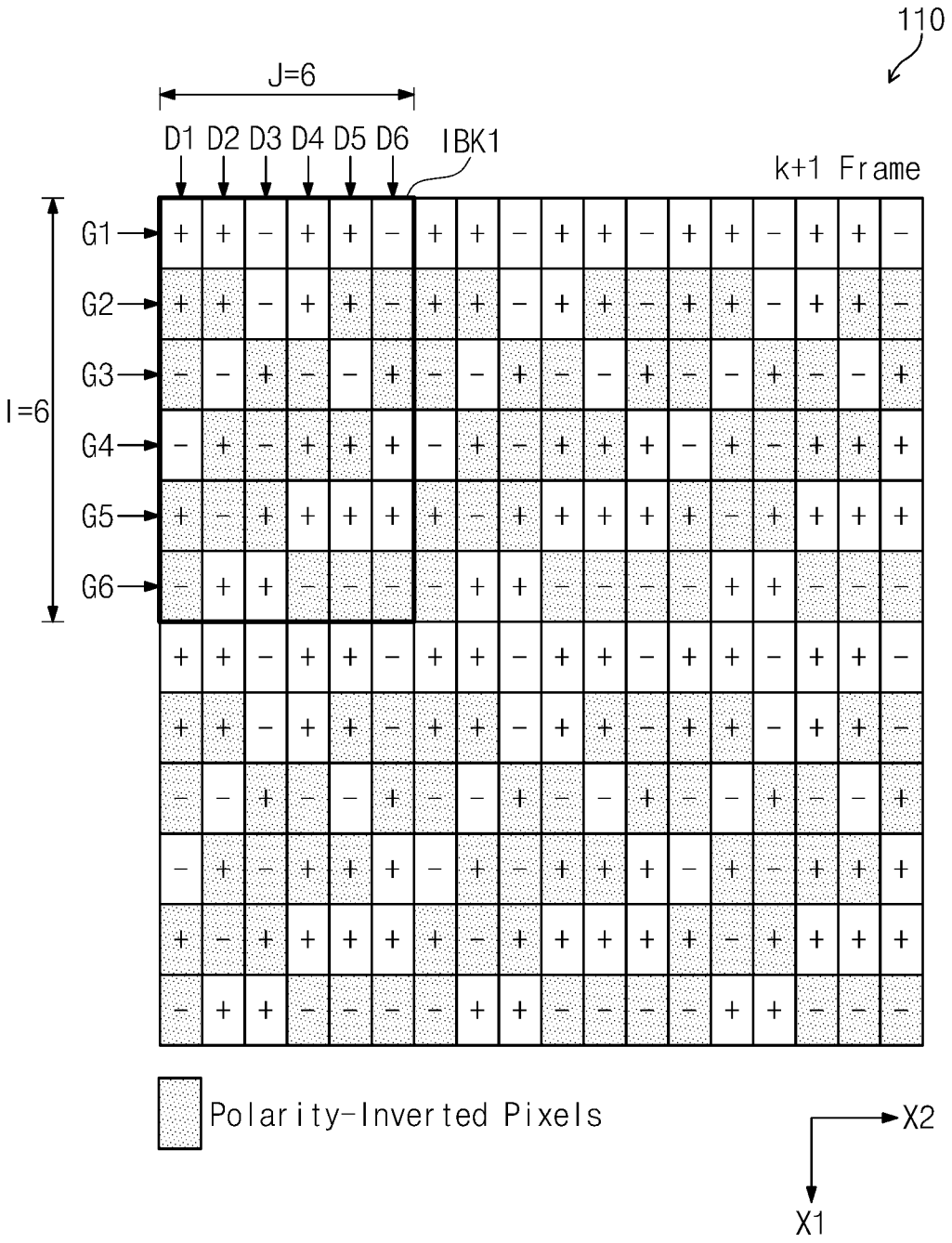

Referring to FIG. 6, in the (K+1)-th frame, the polarity inversion pattern of the pixels in the inversion block IBK1 is different from the polarity inversion pattern shown in FIG. 5. The polarity inversion pattern of the pixels in the inversion block IBK1 is repeated in the first direction X1 at every I pixels and in the second direction X2 at every J pixels. For instance, the pixels connected to the data line D1 are operated with the polarities of +, +, −, −, +, and − in the unit of the I pixels along the first direction X1, the pixels connected to the data line D2 are operated with the polarities of +, +, −, +, −, and + in the unit of the I pixels along the first direction X1, the pixels connected to the data line D3 are operated with the polarities of −, −, +, −, +, and + in the unit of the I pixels along the first direction X1, the pixels connected to the data line D4 are operated with the polarities of +, +, −, +, +, and − in the unit of the I pixels along the first direction X1, the pixels connected to the data line D5 are operated with the polarities of +, +, −, +, +, and − in the unit of the I pixels along the first direction X1, and the pixels connected to the data line D6 are operated with the polarities of −, −, +, +, +, and − in the unit of the I pixels along the first direction X1.

The pixels connected to the gate line G1 are operated with the polarities of +, +, −, +, +, and − in the unit of the J pixels along the second direction X2, the pixels connected to the gate line G2 are operated with the polarities of +, +, −, +, +, and − in the unit of the J pixels along the second direction X2, the pixels connected to the gate line G3 are operated with the polarities of −, −, +, −, −, and + in the unit of the J pixels along the second direction X2, the pixels connected to the gate line G4 are operated with the polarities of −, +, −, +, +, and + in the unit of the J pixels along the second direction X2, the pixels connected to the gate line G5 are operated with the polarities of +, −, +, +, +, and + in the unit of the J pixels along the second direction X2, and the pixels connected to the gate line G6 are operated with the polarities of −, +, +, −, −, and − in the unit of the J pixels along the second direction X2. As the above-described manner, the polarities of m by n pixels connected to the data lines D1 to Dm and the gate lines G1 to Gn shown in FIG. 1 may be determined.

Figure 7:
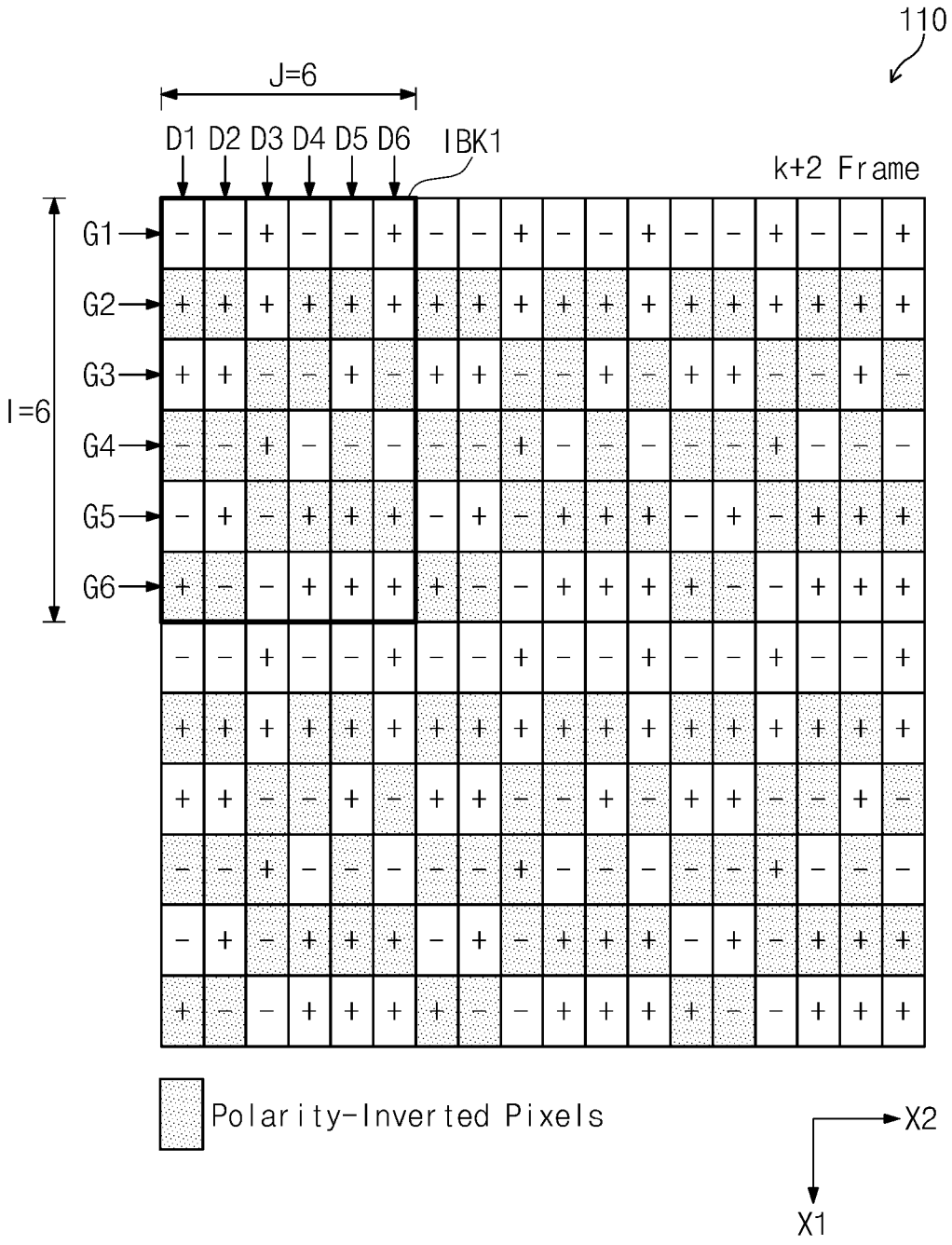

Referring to FIG. 7, in the (K+2)-th frame, the polarity inversion pattern of the pixels in the inversion block IBK1 is different from the polarity inversion patterns respectively shown in FIG. 5 and FIG. 6. The polarity inversion pattern of the pixels in the inversion block IBK1 is repeated in the first direction X1 at every I pixels and in the second direction X2 at every J pixels. For instance, the pixels connected to the data line D1 are operated with the polarities of −, +, +, −, −, and + in the unit of the I pixels along the first direction X1, the pixels connected to the data line D2 are operated with the polarities of −, +, +, −, +, and − in the unit of the I pixels along the first direction X1, the pixels connected to the data line D3 are operated with the polarities of +, +, −, +, −, and − in the unit of the I pixels along the first direction X1, the pixels connected to the data line D4 are operated with the polarities of −, +, −, −, +, and + in the unit of the I pixels along the first direction X1, the pixels connected to the data line D5 are operated with the polarities of −, +, +, −, +, and + in the unit of the I pixels along the first direction X1, and the pixels connected to the data line D6 are operated with the polarities of +, +, −, −, +, and + in the unit of the I pixels along the first direction X1.

The pixels connected to the gate line G1 are operated with the polarities of −, −, +, −, −, and + in the unit of the J pixels along the second direction X2, the pixels connected to the gate line G2 are operated with the polarities of +, +, +, +, +, and + in the unit of the J pixels along the second direction X2, the pixels connected to the gate line G3 are operated with the polarities of +, +, −, −, +, and − in the unit of the J pixels along the second direction X2, the pixels connected to the gate line G4 are operated with the polarities of −, −, +, −, −, and − in the unit of the J pixels along the second direction X2, the pixels connected to the gate line G5 are operated with the polarities of −, +, −, +, +, and + in the unit of the J pixels along the second direction X2, and the pixels connected to the gate line G6 are operated with the polarities of +, −, −, +, +, and + in the unit of the J pixels along the second direction X2. As the above-described manner, the polarities of m by n pixels connected to the data lines D1 to Dm and the gate lines G1 to Gn shown in FIG. 1 may be determined.

Figure 8:
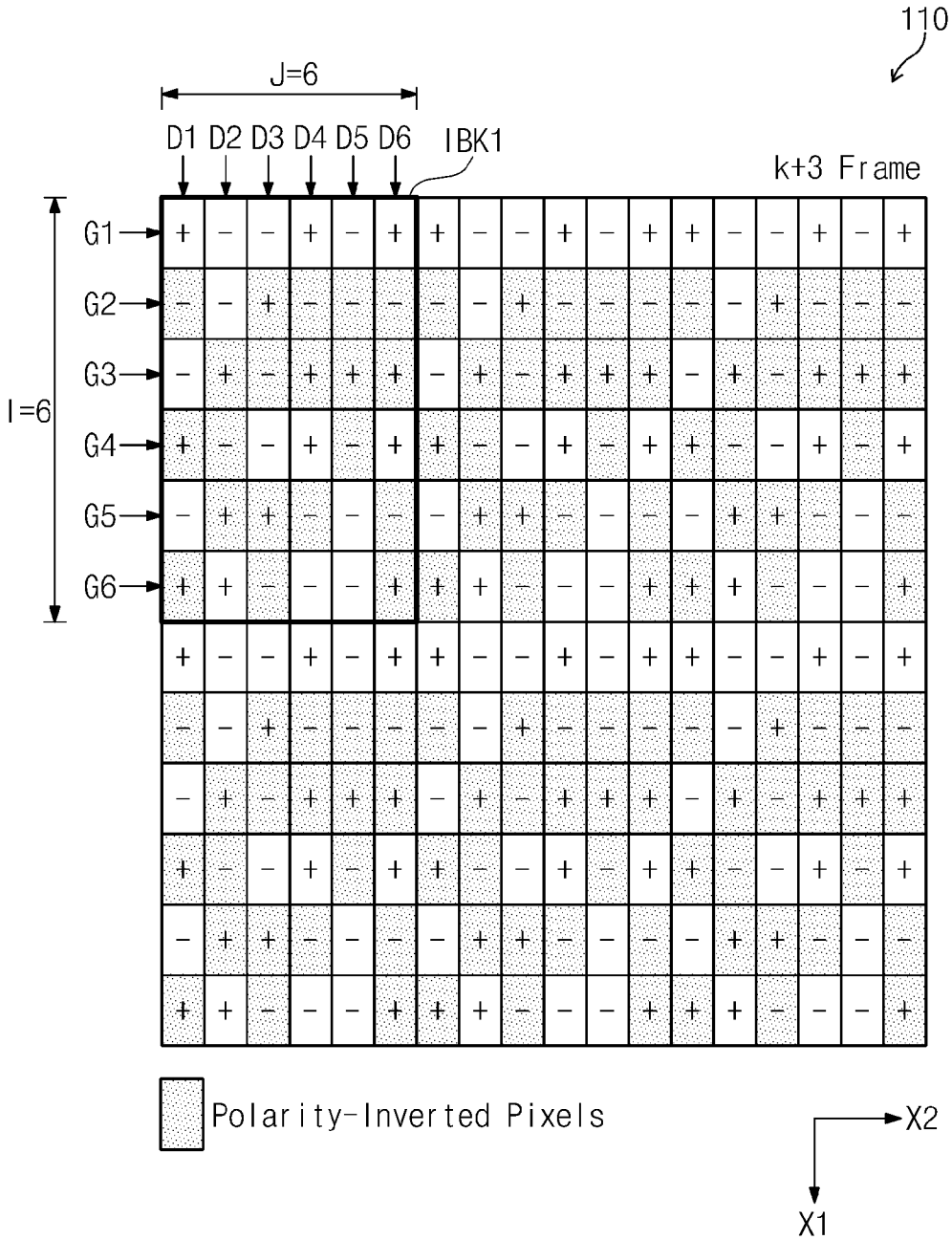

Referring to FIG. 8, in the (K+3)-th frame, the polarity inversion pattern of the pixels in the inversion block IBK1 is different from the polarity inversion patterns respectively shown in FIG. 5, FIG. 6, and FIG. 7. The polarity inversion pattern of the pixels in the inversion block IBK1 is repeated in the first direction X1 at every I pixels and in the second direction X2 at every J pixels. For instance, the pixels connected to the data line D1 are operated with the polarities of +, −, −, +, −, and + in the unit of the I pixels along the first direction X1, the pixels connected to the data line D2 are operated with the polarities of −, −, +, −, +, and + in the unit of the I pixels along the first direction X1, the pixels connected to the data line D3 are operated with the polarities of −, +, −, −, +, and − in the unit of the I pixels along the first direction X1, the pixels connected to the data line D4 are operated with the polarities of +, −, +, +, −, and − in the unit of the I pixels along the first direction X1, the pixels connected to the data line D5 are operated with the polarities of −, −, +, −, −, and − in the unit of the I pixels along the first direction X1, and the pixels connected to the data line D6 are operated with the polarities of +, −, +, +, −, and + in the unit of the I pixels along the first direction X1.

The pixels connected to the gate line G1 are operated with the polarities of +, −, −, +, −, and + in the unit of the J pixels along the second direction X2, the pixels connected to the gate line G2 are operated with the polarities of −, −, +, −, −, and − in the unit of the J pixels along the second direction X2, the pixels connected to the gate line G3 are operated with the polarities of −, +, −, +, +, and + in the unit of the J pixels along the second direction X2, the pixels connected to the gate line G4 are operated with the polarities of +, −, −, +, −, and + in the unit of the J pixels along the second direction X2, the pixels connected to the gate line G5 are operated with the polarities of −, +, +, −, −, and − in the unit of the J pixels along the second direction X2, and the pixels connected to the gate line G6 are operated with the polarities of +, +, −, −, −, and + in the unit of the J pixels along the second direction X2. As the above-described manner, the polarities of m by n pixels connected to the data lines D1 to Dm and the gate lines G1 to Gn shown in FIG. 1 may be determined.

Figure 9:
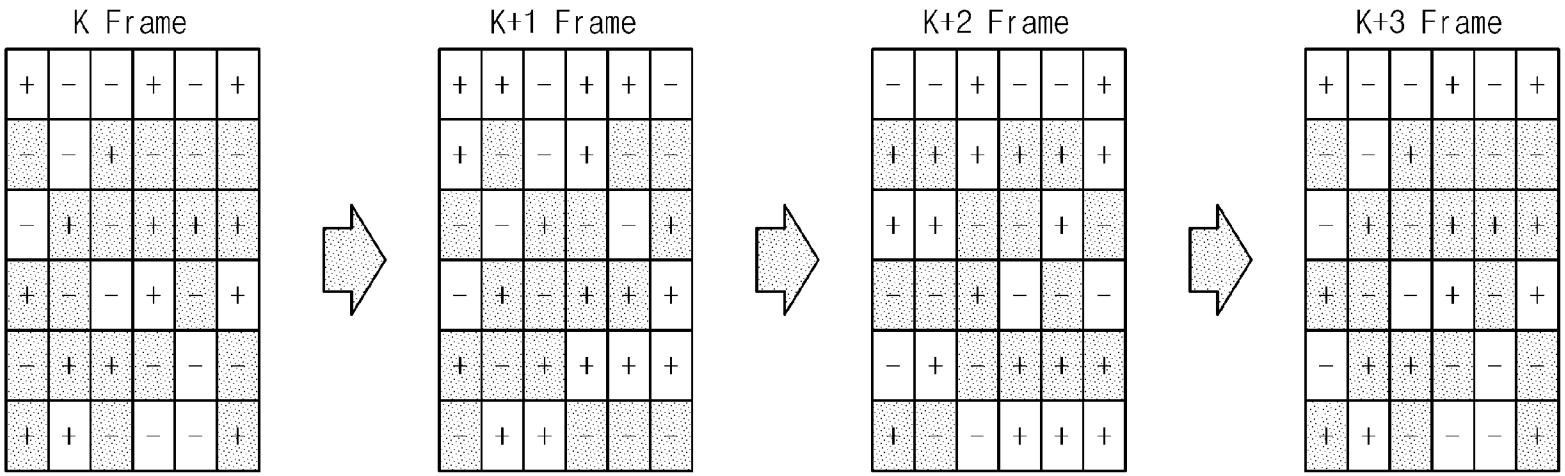
FIG. 9 is a view showing an inversion block shown in FIGS. 5 to 8, which is inversion-driven in successive four frames.

FIG. 9 is a view showing an inversion block shown in FIG. 5, FIG. 6, FIG. 7, and FIG. 8, which is inversion-driven in successive four frames.

Referring to FIG. 9, the inversion block IBK1 of the display panel 110 is operated in different polarity inversion pattern during the successive K frames. In the present exemplary embodiment, K is 4, but it should not be limited to 4. That is, K may be one of positive integers. As described with reference to FIGS. 5 to 8, since the polarity inversion of the pixels in the inversion block IBK1 configured to include I by J pixels do not regularly occur, the ripple of the common voltage VCOM may be reduced. In addition, when the pixels in the inversion block IBK1 are randomly inversion-operated during K frames, the display defect occurring during one frame appears in different on the display panel 110 in every frame. As a result, the display defect is difficult to be perceived by a user, and the display quality of the image displayed on the display panel 110 may be improved.

FIG. 10, FIG. 11, FIG. 12, FIG. 13, FIG. 14, FIG. 15, FIG. 16, and FIG. 17 are timing diagrams showing the inversion control signal output from the timing controller shown in FIG. 1.

Figure 10:
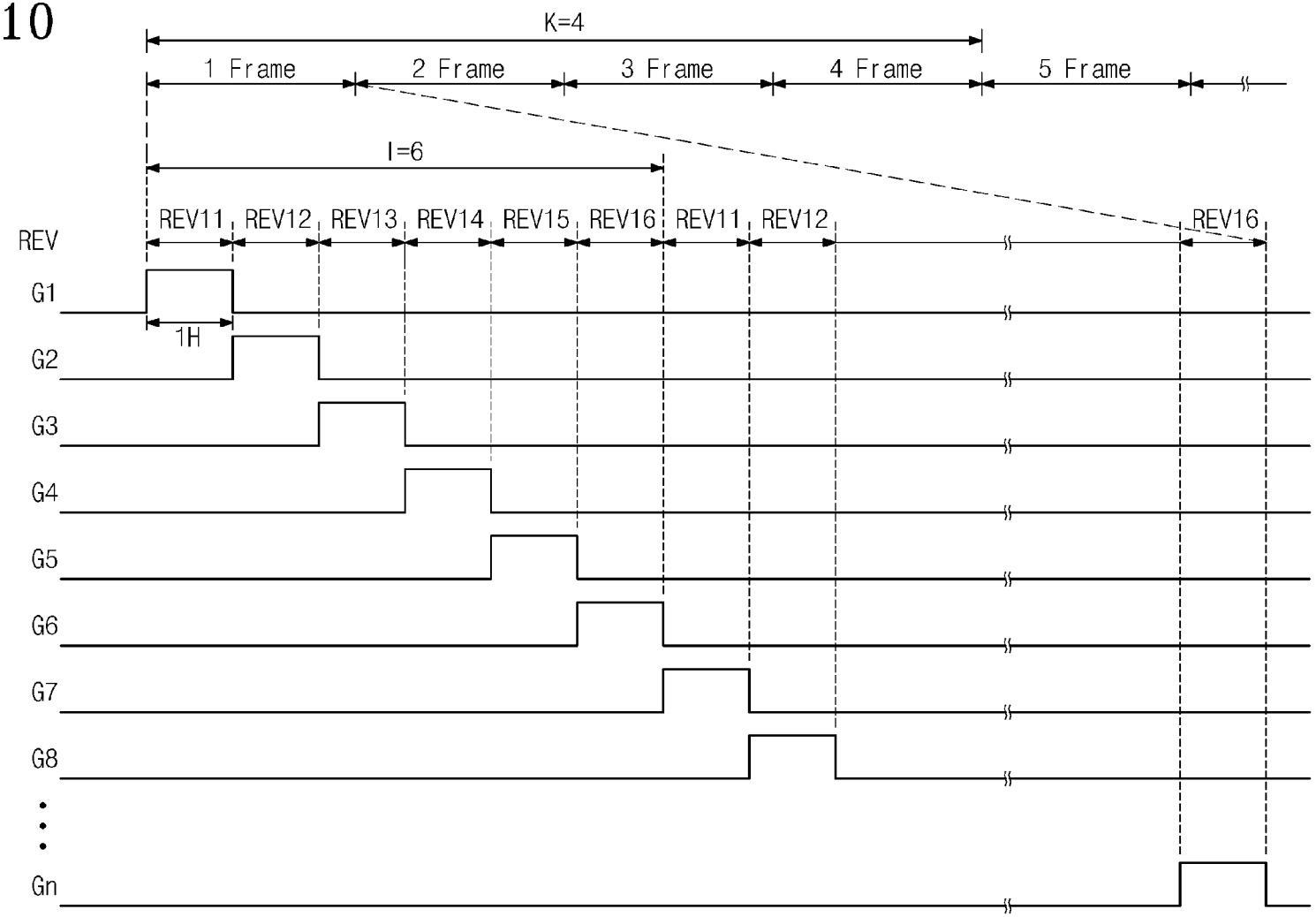
FIG. 10 is a timing diagram showing an inversion control signal in a first frame.

FIG. 10 is a timing diagram showing an inversion control signal in a first frame.

As described above, the m by n pixels are inversion-operated at every four (k) frames. In addition, the m by n pixels are inversion-operated at every six (I) pixels in the first direction X1 and at every six (J) pixels in the second direction X2. The inversion control signal REV carries inversion information of each of the m by n pixels during one frame.

Referring to FIG. 10, the inversion control signal REV has a pattern that is repeated at every six (I) gate lines during a first frame. In detail, the inversion control signal REV has a first pattern REV 11 while the gate line G1 is driven, a second pattern REV 12 while the gate line G2 is driven, a third pattern REV 13 while the gate line G3 is driven, a fourth pattern REV 14 while the gate line G4 is driven, a fifth pattern REV 15 while the gate line G5 is driven, and a sixth pattern REV 16 while the gate line G6 is driven. The inversion control signal REV repeatedly has the first to sixth patterns REV 11 to REV 16 while the gate lines G1 to Gn are sequentially driven. In other words, the inversion control signal REV sequentially has the first to sixth patterns REV 11 to REV 16 during the first frame, and the first to sixth patterns REV 11 to REV 16 are repeated.

Figure 11:
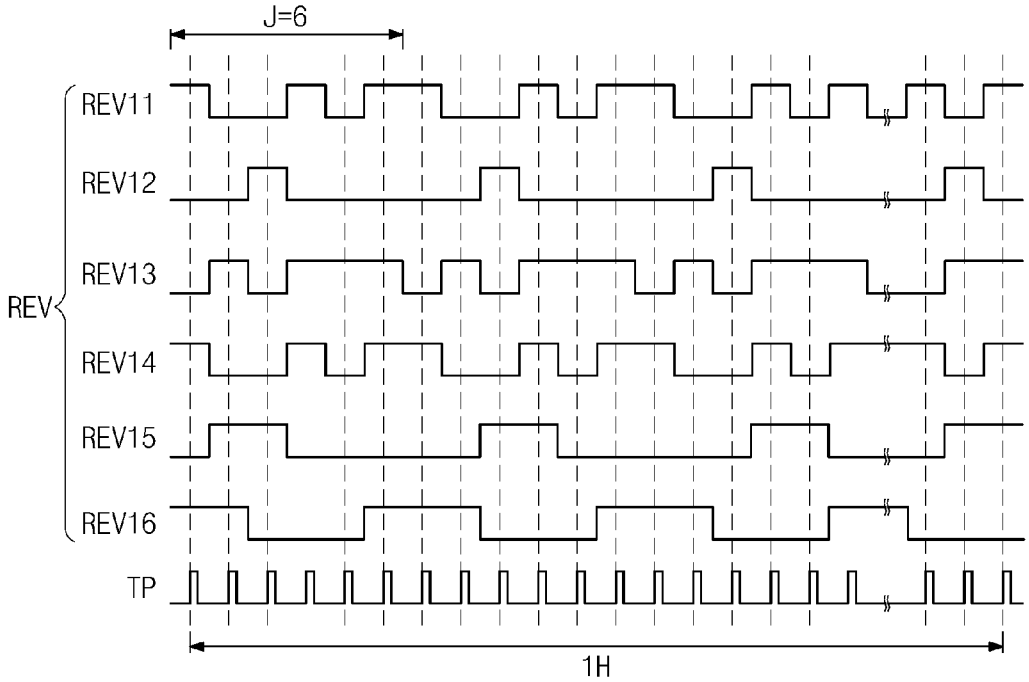
FIG. 11 is a timing diagram showing first to sixth patterns of the inversion control signal shown in FIG. 10.

FIG. 11 is a timing diagram showing first to sixth patterns of the inversion control signal shown in FIG. 10.

Referring to FIG. 5, FIG. 10, and FIG. 11, the first pattern REV 11 of the inversion control signal REV indicates polarity inversion information of the pixels in the second direction X2 of the display panel 110 while the gate line G1 is driven. The data driver 130 shown in FIG. 1 determines the polarity of the gray-scale voltages applied to the data lines D1 to Dm in response to the line latch signal TP and the inversion control signal REV included in the first control signal CONT1 from the timing controller 120. That is, when the inversion control signal REV is a high level in synchronization with the line latch signal TP, the gray-scale voltage that drives the corresponding data line has a positive (+) polarity, and when the inversion control signal REV is a low level in synchronization with the line latch signal TP, the gray-scale voltage that drives the corresponding data line has a negative (+) polarity.

That is, when the gate line G1 is driven by the gate-on voltage VON, the data driver 130 drives the pixels connected to the data lines D1 to Dm with the polarities of +, −, −, +, −, +, +, −, −, +, −, +, . . . , etc. in response to the first pattern REV 11 of the inversion control signal REV. When the gate line G2 is driven by the gate-on voltage VON, the data driver 130 drives the pixels connected to the data lines D1 to Dm with the polarities of −, −, +, −, −, −, −, −, +, −, −, −, . . . , etc. in response to the second pattern REV 12 of the inversion control signal REV. As described above, when the gate lines G1 to Gn are sequentially operated during one frame, the gray-scale voltages corresponding to the data signal DATA may be provided to the m by n pixels arranged on the display panel 110.

Figure 12:
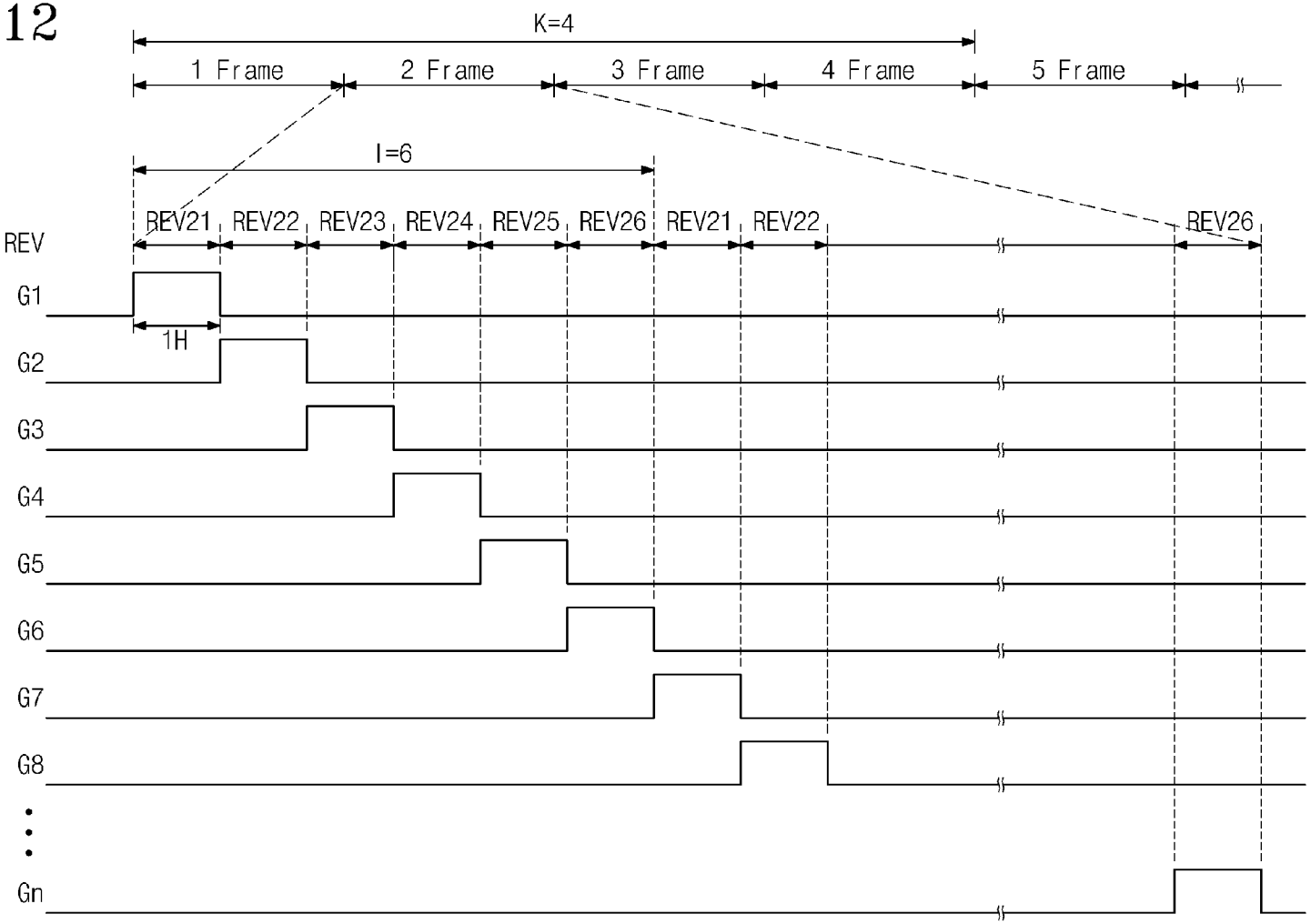
FIG. 12 is a timing diagram showing an inversion control signal in a second frame.

FIG. 12 is a timing diagram showing an inversion control signal in a second frame.

Referring to FIG. 12, the inversion control signal REV has a pattern that is repeated at every six (I) gate lines during a second frame. In detail, the inversion control signal REV has a seventh pattern REV21 while the gate line G1 is driven, an eighth pattern REV22 while the gate line G2 is driven, a ninth pattern REV23 while the gate line G3 is driven, a tenth pattern REV24 while the gate line G4 is driven, an eleventh pattern REV25 while the gate line G5 is driven, and a twelfth pattern REV26 while the gate line G6 is driven. The inversion control signal REV has the seventh pattern REV21 again while the seventh gate line G7 is driven. The inversion control signal REV repeatedly has the seventh to twelfth patterns REV21 to REV26 while the gate lines G1 to Gn are sequentially driven. In other words, the inversion control signal REV sequentially has the seventh to twelfth patterns REV21 to REV26 during the second frame, and the seventh to twelfth patterns REV21 to REV26 are repeated.

Figure 13:
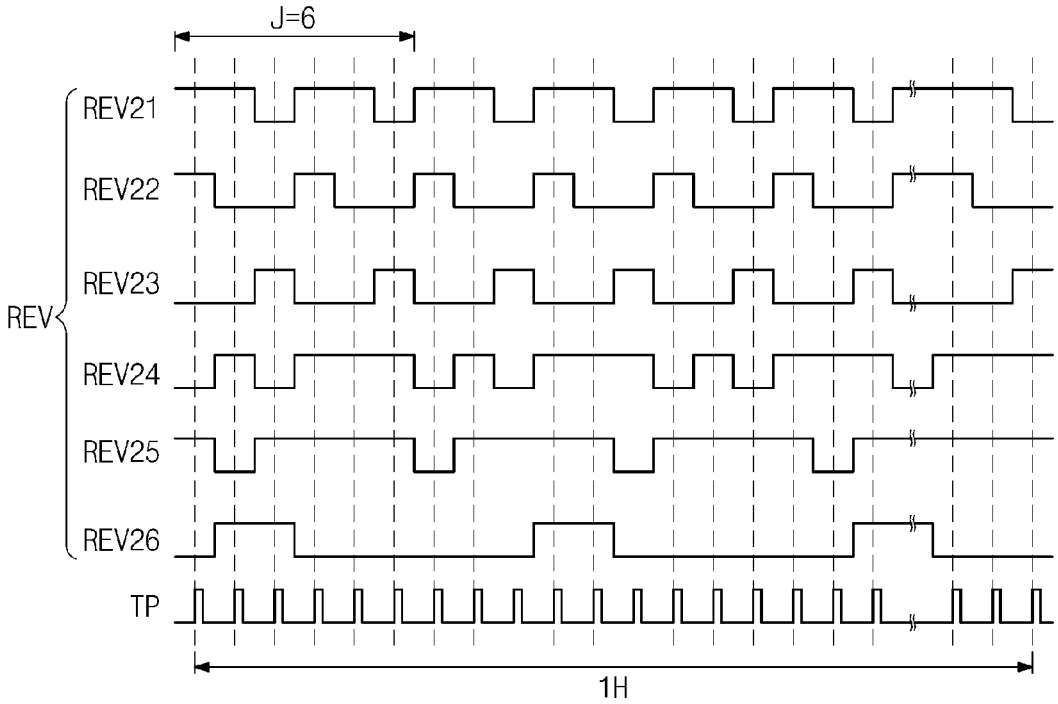
FIG. 13 is a timing diagram showing seventh to twelfth patterns of the inversion control signal shown in FIG. 12.

FIG. 13 is a timing diagram showing seventh to twelfth patterns of the inversion control signal shown in FIG. 12.

Referring to FIG. 6, FIG. 12, and FIG. 13, the seventh pattern REV21 of the inversion control signal REV indicates polarity inversion information of the pixels in the second direction X2 of the display panel 110 while the gate line G1 is driven. That is, when the gate line G1 is driven by the gate-on voltage VON, the data driver 130 drives the pixels connected to the data lines D1 to Dm with the polarities of +, +, −, +, +, −, +, +, −, +, +, −, . . . , etc. in response to the seventh pattern REV21 of the inversion control signal REV. When the gate line G2 is driven by the gate-on voltage VON, the data driver 130 drives the pixels connected to the data lines D1 to Dm with the polarities of +, −, −, +, −, −, +, −, −, +, −, −, . . . , etc. in response to the eighth pattern REV22 of the inversion control signal REV. As described above, when the gate lines G1 to Gn are sequentially operated during one frame, the gray-scale voltages corresponding to the data signal DATA may be provided to the m by n pixels arranged on the display panel 110.

Figure 14:
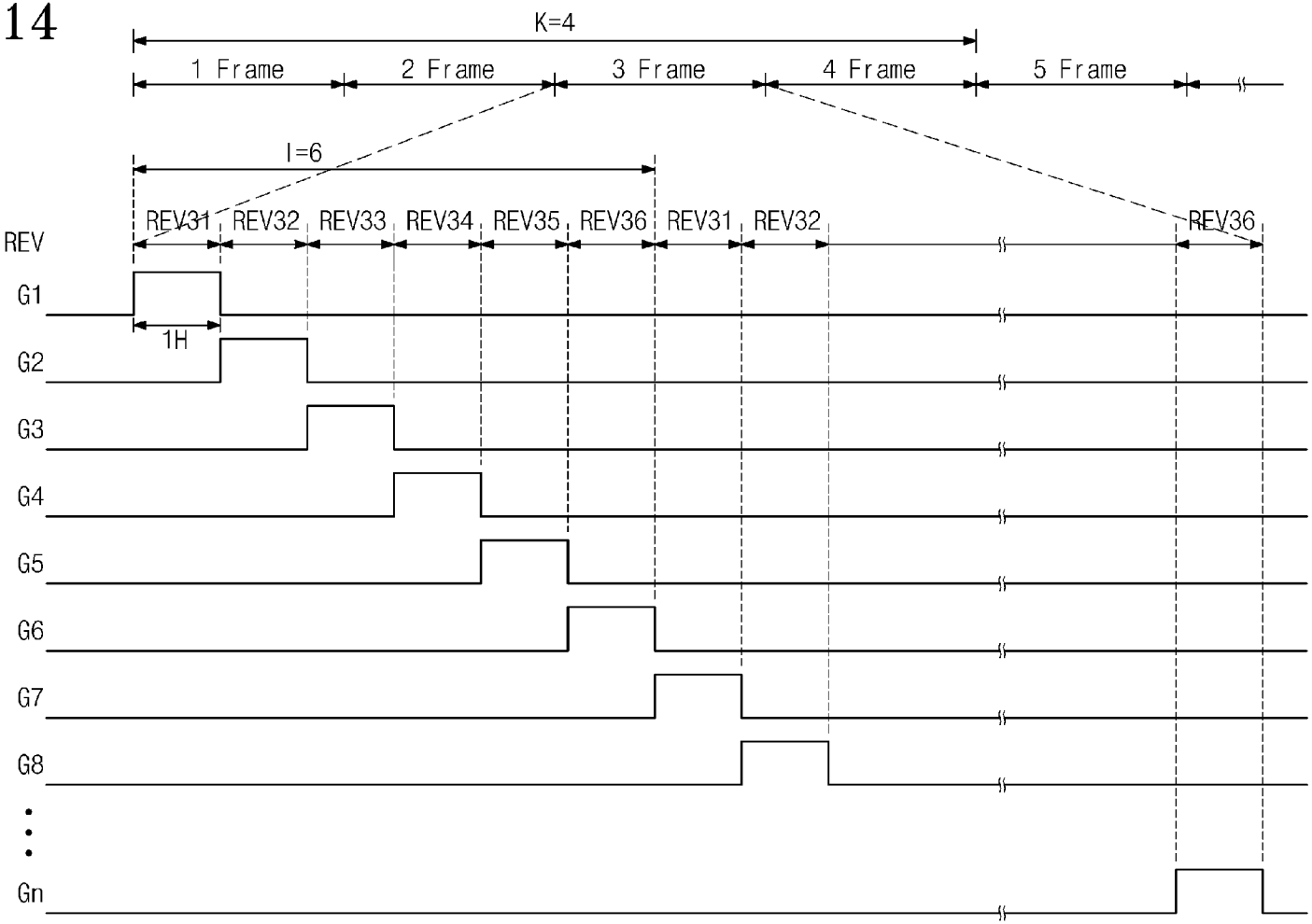
FIG. 14 is a timing diagram showing an inversion control signal in a third frame.

FIG. 14 is a timing diagram showing an inversion control signal in a third frame.

Referring to FIG. 14, the inversion control signal REV has a pattern that is repeated at every six (I) gate lines during a third frame. That is, the inversion control signal REV has a thirteenth pattern REV31 while the gate line G1 is driven, a fourteenth pattern REV32 while the gate line G2 is driven, a fifteenth pattern REV33 while the gate line G3 is driven, a sixteenth pattern REV34 while the gate line G4 is driven, a seventeenth pattern REV35 while the gate line G5 is driven, and an eighteenth pattern REV36 while the gate line G6 is driven. The inversion control signal REV has the thirteenth pattern REV21 again while the seventh gate line G7 is driven. The inversion control signal REV repeatedly has the thirteenth to eighteenth patterns REV31 to REV36 while the gate lines G1 to Gn are sequentially driven. In other words, the inversion control signal REV sequentially has the thirteenth to eighteenth patterns REV31 to REV36 during the second frame, and the thirteenth to eighteenth patterns REV31 to REV36 are repeated.

Figure 15:
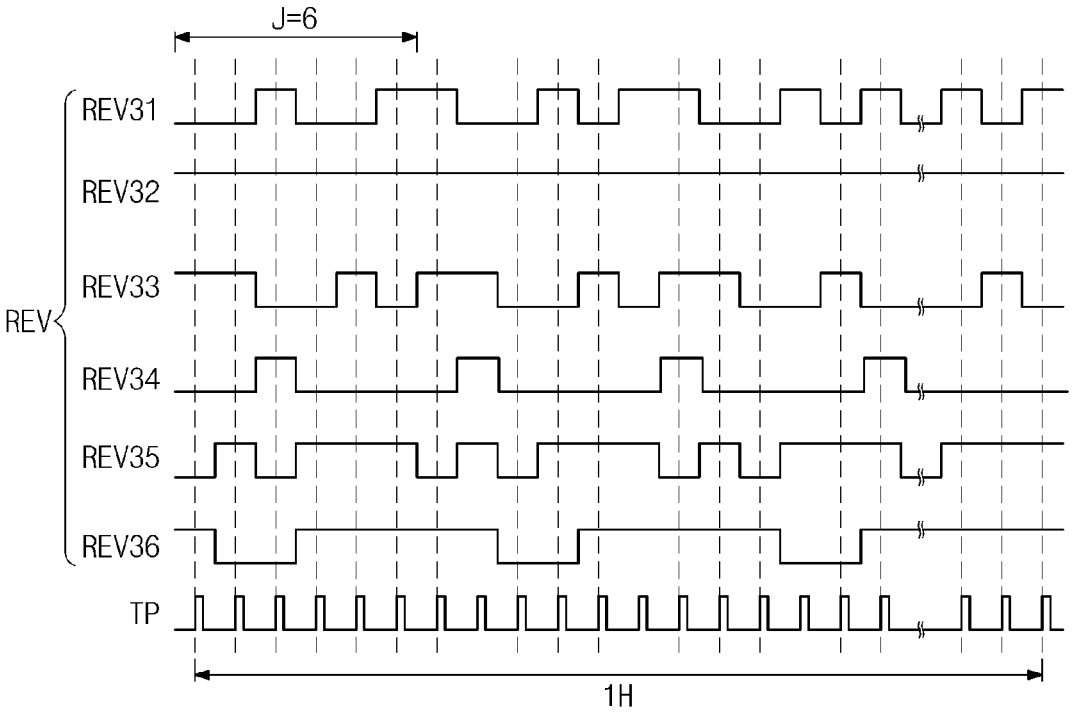
FIG. 15 is a timing diagram showing thirteenth to eighteenth patterns of the inversion control signal shown in FIG. 14.

FIG. 15 is a timing diagram showing thirteenth to eighteenth patterns of the inversion control signal shown in FIG. 14.

Referring to FIG. 7, FIG. 14, and FIG. 15, the thirteenth pattern REV31 of the inversion control signal REV indicates polarity inversion information of the pixels in the second direction X2 of the display panel 110 while the gate line G1 is driven. That is, when the gate line G1 is driven by the gate-on voltage VON, the data driver 130 drives the pixels connected to the data lines D1 to Dm with the polarities of −, −, +, −, −, +, −, −, +, −, −, +, . . . , etc. in response to the thirteenth pattern REV31 of the inversion control signal REV. When the gate line G2 is driven by the gate-on voltage VON, the data driver 130 drives the pixels connected to the data lines D1 to Dm with the polarities of +, +, +, +, +, +, +, +, +, +, +, +, . . . , etc. in response to the fourteenth pattern REV32 of the inversion control signal REV. As described above, when the gate lines G1 to Gn are sequentially operated during one frame, the gray-scale voltages corresponding to the data signal DATA may be provided to the m by n pixels arranged on the display panel 110.

Figure 16:
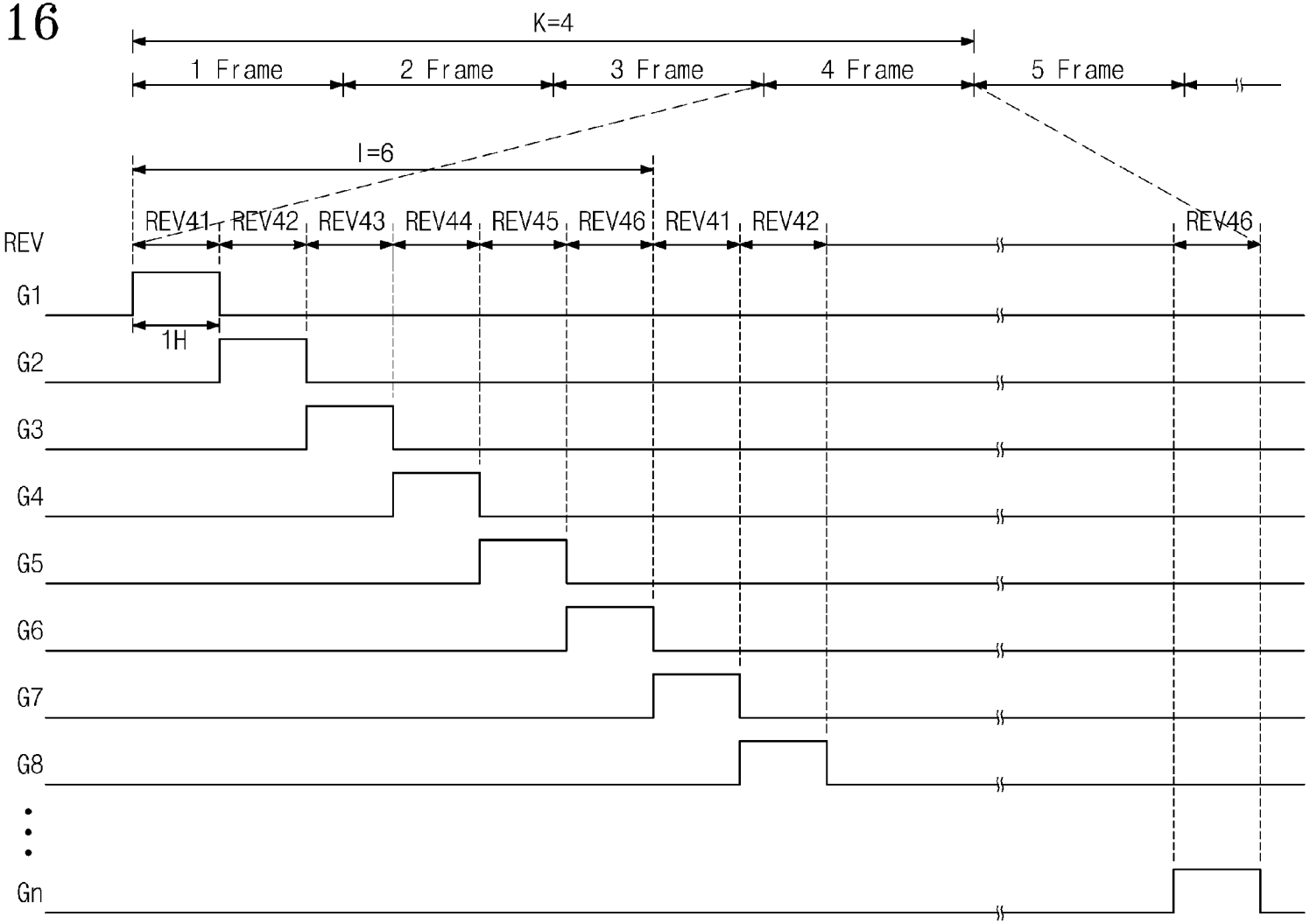
FIG. 16 is a timing diagram showing an inversion control signal in a fourth frame.

FIG. 16 is a timing diagram showing an inversion control signal in a fourth frame.

Referring to FIG. 16, the inversion control signal REV has a pattern that is repeated at every six (I) gate lines during a fourth frame. That is, the inversion control signal REV has a ninteenth pattern REV41 while the gate line G1 is driven, a twentieth pattern REV42 while the gate line G2 is driven, a twenty-first pattern REV43 while the gate line G3 is driven, a twenty-second pattern REV44 while the gate line G4 is driven, a twenty-third pattern REV45 while the gate line G5 is driven, and a twenty-fourth pattern REV46 while the gate line G6 is driven. The inversion control signal REV has the nineteenth pattern REV41 again while the seventh gate line G7 is driven. The inversion control signal REV repeatedly has the nineteenth to twenty-fourth patterns REV41 to REV46 while the gate lines G1 to Gn are sequentially driven. In other words, the inversion control signal REV sequentially has the nineteenth to twenty-fourth patterns REV41 to REV46 during the fourth frame, and the nineteenth to twenty-fourth patterns REV41 to REV46 are repeated.

Figure 17:
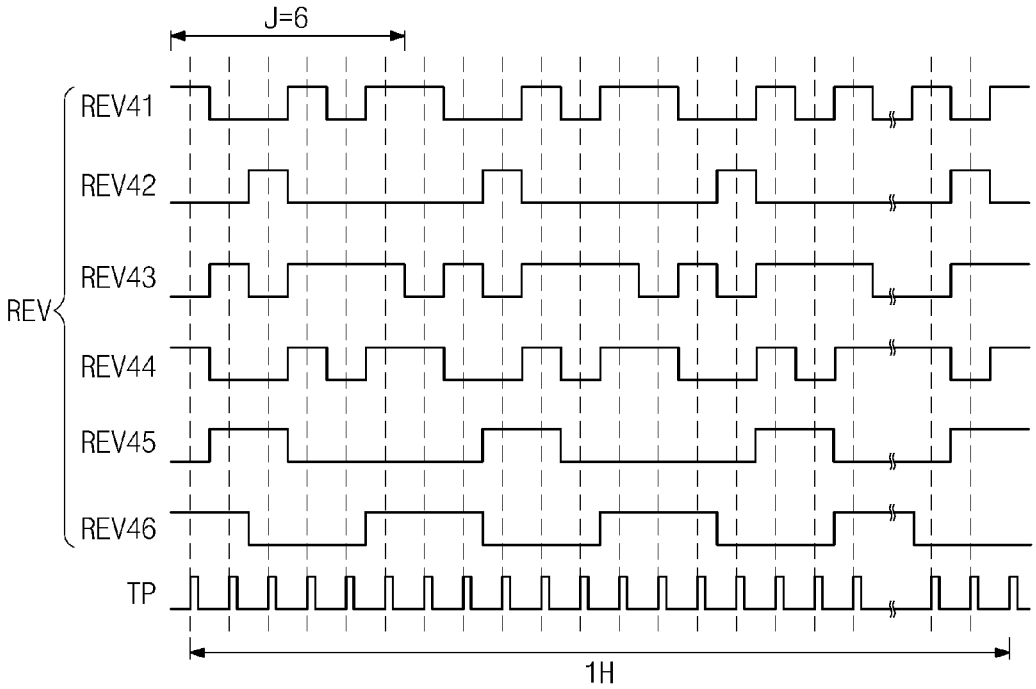
FIG. 17 is a timing diagram showing nineteenth to twenty-fourth patterns of the inversion control signal shown in FIG. 16.

FIG. 17 is a timing diagram showing nineteenth to twenty-fourth patterns of the inversion control signal shown in FIG. 16.

Referring to FIG. 8, FIG. 16, and FIG. 17, the nineteenth pattern REV41 of the inversion control signal REV indicates polarity inversion information of the pixels in the second direction X2 of the display panel 110 while the gate line G1 is driven. That is, when the gate line G1 is driven by the gate-on voltage VON, the data driver 130 drives the pixels connected to the data lines D1 to Dm with the polarities of +, −, −, +, −, +, +, −, −, +, −, +, . . . , etc. in response to the nineteenth pattern REV41 of the inversion control signal REV. When the gate line G2 is driven by the gate-on voltage VON, the data driver 130 drives the pixels connected to the data lines D1 to Dm with the polarities of −, −, +, −, −, −, −, −, +, −, −, −, . . . , etc. in response to the fourteenth pattern REV32 of the inversion control signal REV. As described above, when the gate lines G1 to Gn are sequentially operated during one frame, the gray-scale voltages corresponding to the data signal DATA may be provided to the m by n pixels arranged on the display panel 110.

Figure 18:
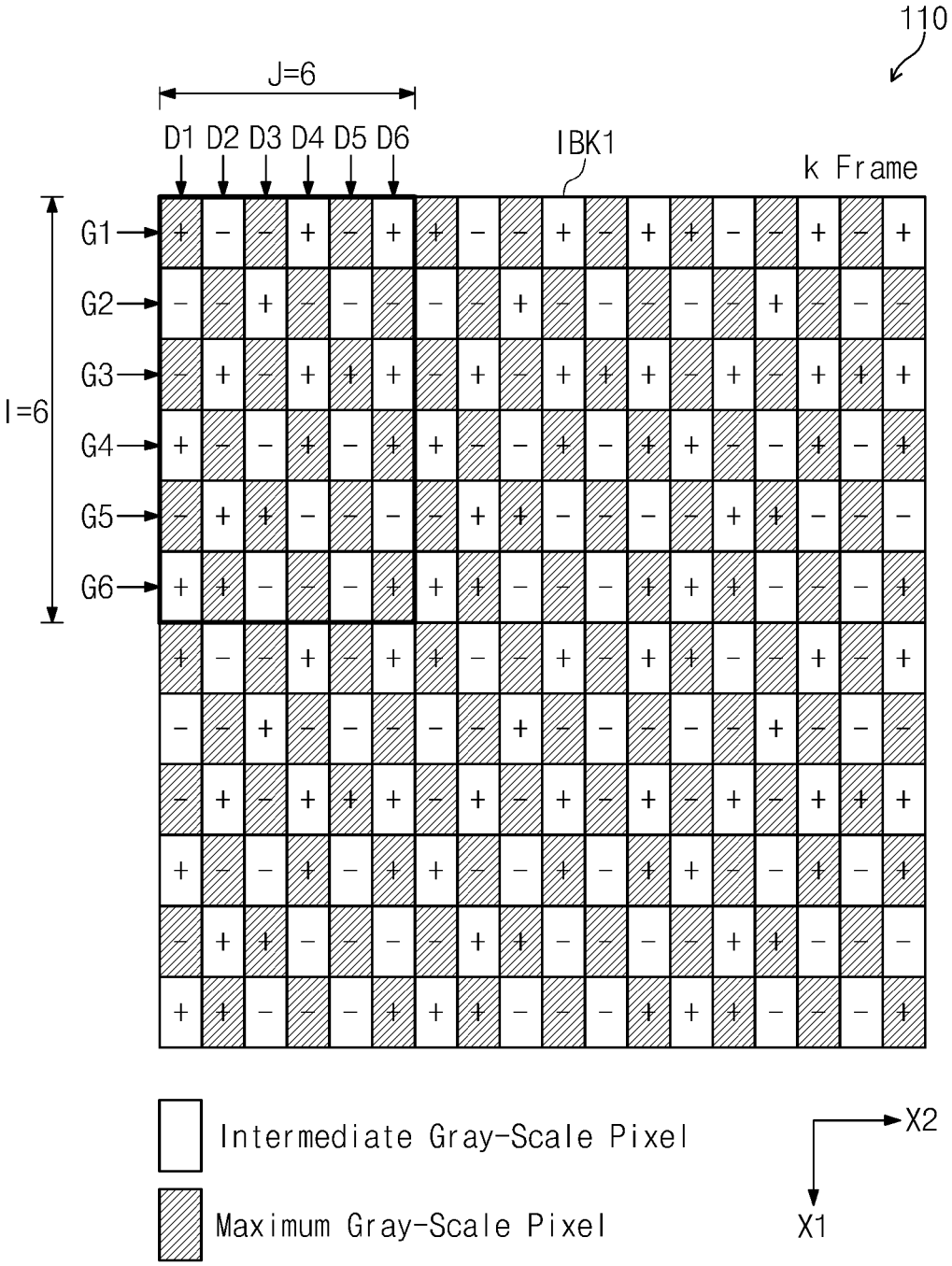
FIG. 18 is a view showing an example of a K-th frame to which a scattering inversion driving scheme is applied according to an exemplary embodiment of the present invention.

FIG. 18 is a view showing an example of a K-th frame to which a scattering inversion driving scheme is applied according to an exemplary embodiment of the present invention.

Referring to FIG. 18, in the case of the scattering inversion driving scheme, the I by J pixels in the inversion block IBK1 are randomly inversion-operated. In the scattering inversion driving scheme, when one-dot checker pattern appears on the display panel 110, a maximum gray-scale voltage and an intermediate gray-scale voltage are alternately applied to the pixels arranged in the first direction X1 and the second direction X2. In the case that the liquid crystal display 100 is operated in the normally white mode, the pixels applied with the maximum gray-scale voltage display black images.

Figure 19:
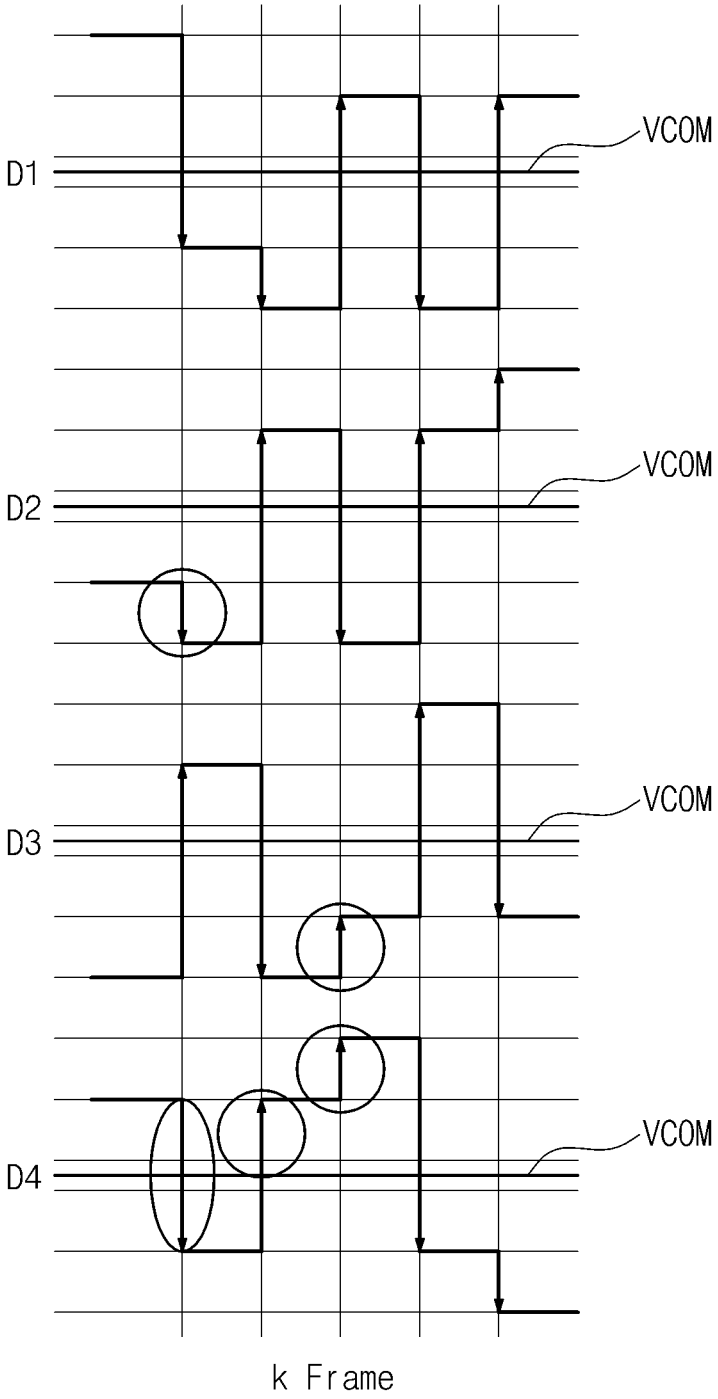
FIG. 19 is a view showing the variation of polarities of gray-scale voltages used to drive data lines in the scattering inversion driving scheme shown in FIG. 18.

FIG. 19 is a view showing the variation of polarities of gray-scale voltages used to drive data lines in the scattering inversion driving scheme shown in FIG. 18.

Referring to FIG. 18 and FIG. 19, the pixels connected to the data line D1 of the display panel 110 are sequentially operated with the polarities of +, −, −, +, −, +, . . . , etc. in the first direction X1, the pixels connected to the data line D2 are sequentially operated with the polarities of −, −, +, −, +, +, . . . , etc. in the first direction X1, the pixels connected to the data line D3 of the display panel 110 are sequentially operated with the polarities of −, +, −, −, +, −, . . . , etc. in the first direction X1, and the pixels connected to the data line D4 are sequentially operated with the polarities of +, −, +, +, −, −, . . . , etc. in the first direction X1. When the one-dot checker pattern as shown in FIG. 18 is displayed on the display panel 110, the increase and decrease points of the gray-scale voltages that respectively drive the data lines D1 to D4 adjacent to each other are more reduced than those of the gray-scale voltages shown in FIG. 4. Therefore, the horizontal crosstalk and the greenish phenomenon, which are caused by the distortion of the common voltage, may be reduced.

Figure 20:
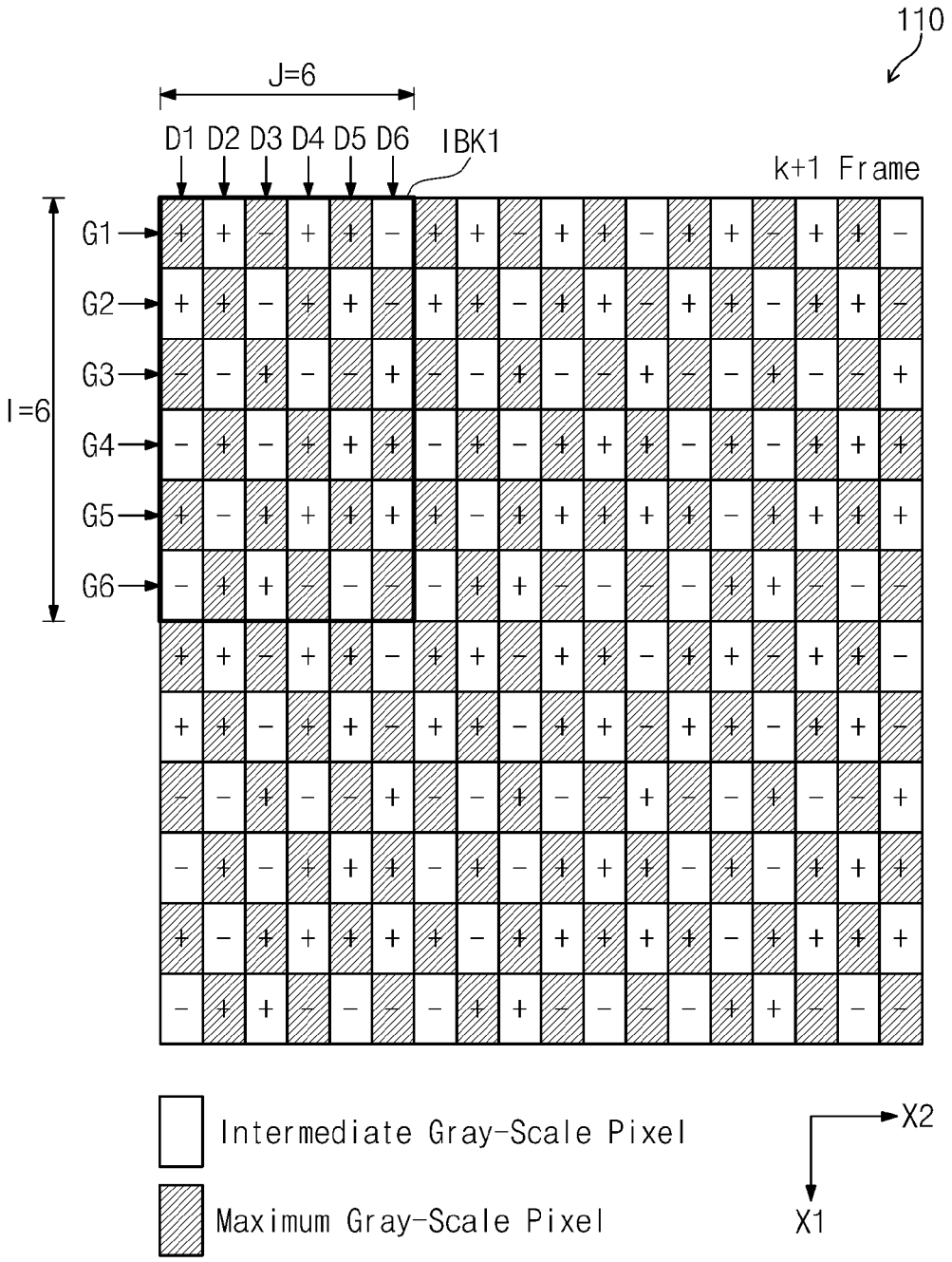
FIG. 20 is a view showing an example of a (K+1)-th frame to which a scattering inversion driving scheme is applied according to an exemplary embodiment of the present invention.
Figure 21:
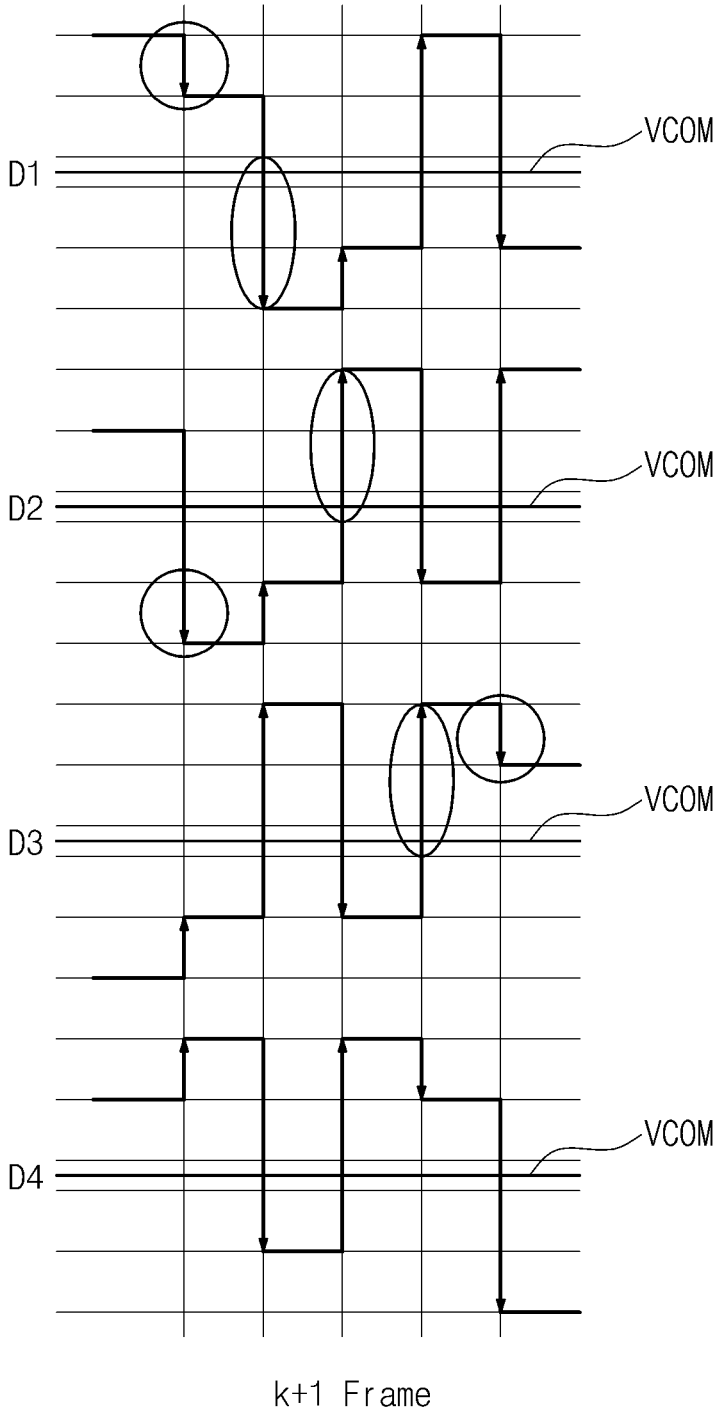
FIG. 21 is a view showing the variation of polarities of gray-scale voltages used to drive data lines in the scattering inversion driving scheme shown in FIG. 20.

FIG. 20 is a view showing an example of a (K+1)th frame to which a scattering inversion driving scheme is applied according to an exemplary embodiment of the present invention, and FIG. 21 is a view showing the variation of polarities of gray-scale voltages used to drive data lines in the scattering inversion driving scheme shown in FIG. 20.

Referring to FIG. 20 and FIG. 21, the pixels connected to the data line D1 of the display panel 110 are sequentially operated with the polarities of +, +, −, −, +, −, . . . , etc. in the first direction X1, the pixels connected to the data line D2 are sequentially operated with the polarities of +, −, −, +, −, +, . . . , etc. in the first direction X1, the pixels connected to the data line D3 of the display panel 110 are sequentially operated with the polarities of −, −, +, −, +, +, . . . , etc. in the first direction X1, and the pixels connected to the data line D4 are sequentially operated with the polarities of +, +, −, +, +, −, . . . , etc. in the first direction X1. When the one-dot checker pattern as shown in FIG. 20 is displayed on the display panel 110, the increase and decrease points of the gray-scale voltages that respectively drive the data lines D1 to D4 adjacent to each other are remarkably reduced than those of the gray-scale voltages shown in FIG. 4. Therefore, the horizontal crosstalk and the greenish phenomenon, which are caused by the distortion of the common voltage, may be reduced.

Figure 22:
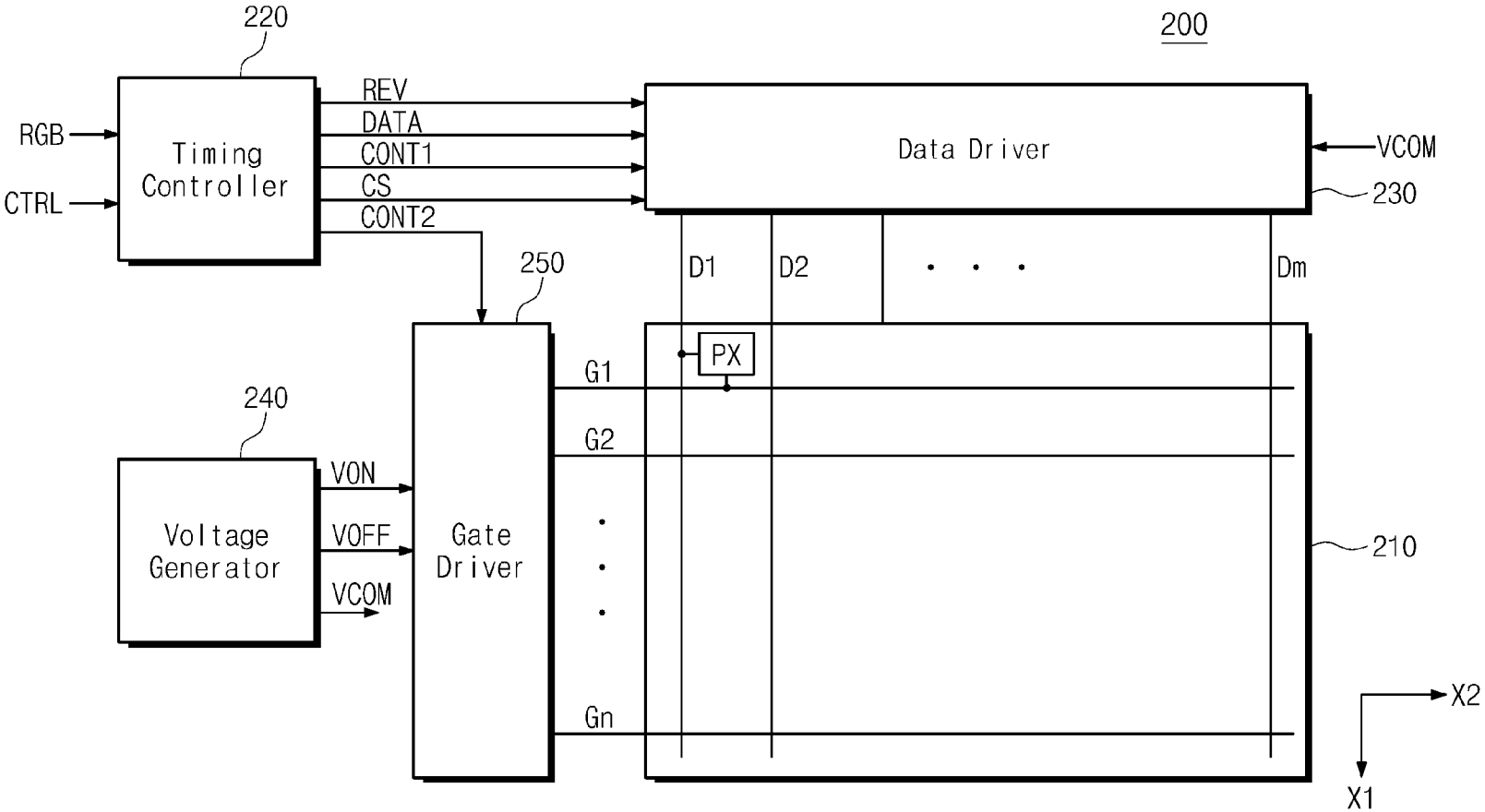
FIG. 22 is a block diagram showing a liquid crystal display according to another exemplary embodiment of the present invention.

FIG. 22 is a block diagram showing a liquid crystal display according to another exemplary embodiment of the present invention.

Referring to FIG. 22, a timing controller 220 of a liquid crystal display 200 further outputs a charge share signal CS. A data driver 230 drives the data lines D1 to Dm using a charge share voltage in response to the charge share signal CS. In the present exemplary embodiment, the charge share voltage is set to the common voltage VCOM, but it should not be limited to the common voltage VCOM. That is, the charge share voltage may be set to a half of a power source voltage AVDD, i.e., AVDD/2, the common voltage VCOM, or The data driver 230 outputs the gray-scale voltages at every horizontal period 1H to the data lines D1 to Dm. That is, the level or polarity of the gray-scale voltages is changed at every horizontal period 1H. As the level of the gray-scale voltages is frequently changed and the change in degree of the gray-scale voltages becomes large, power consumption in the data driver 230 increases. Accordingly, the charge share driving scheme is used so as to reduce the change in degree of the gray-scale voltages. In other words, when the data lines D1 to Dm are set to the intermediate gray-scale voltage between the maximum gray-scale voltage of the positive (+) polarity and the maximum gray-scale voltage of the negative (−) polarity at every horizontal period 1H.

Figure 23:
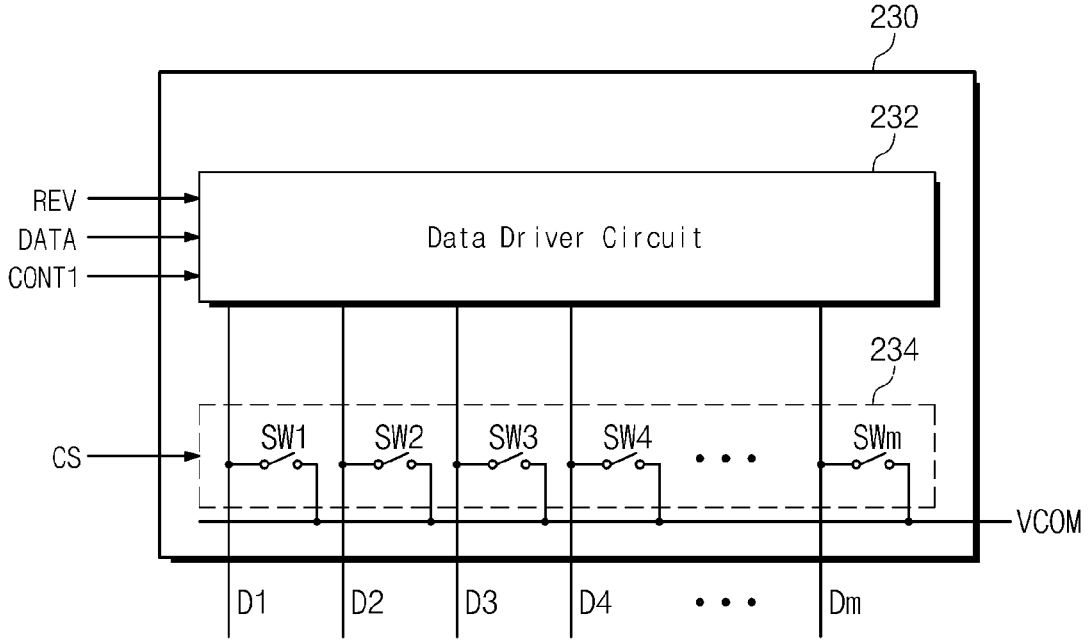
FIG. 23 is a block diagram showing a configuration of a data driver shown in FIG. 22.

FIG. 23 is a block diagram showing a configuration of a data driver shown in FIG. 22.

Referring to FIG. 23, the data driver 230 includes a data driver circuit 232 and a charge share circuit 234. The data driver circuit 232 outputs the gray-scale voltage to drive the data lines D1 to Dm in response to the inversion control signal REV, the data signal DATA, and the first control signal CONT1 from the timing controller 220 shown in FIG. 22.

The charge share circuit 234 drives the data lines D1 to Dm using the common voltage VCOM that is the charge share voltage in response to the charge share signal CS from the timing controller 220. The charge share circuit 234 includes a plurality of switches SW1 to SWm. A first terminal of each of the switches SW1 to SWm is connected to a corresponding data line of the data lines D1 to Dm and a second terminal of each of the switches SW1 to SWm is connected to the common voltage VCOM. The switches SW1 to SWm are turned off in response to the charge share signal CS. For instance, when the charge share signal CS is a low level, the switches SW1 to SWm are turned off. When the charge share signal CS is a high level, the switches SW1 to SWm are turned on, and thus the data lines D1 to Dm are driven by the common voltage VCOM.

According to the above-mentioned charge share driving method, although the pixels of the display panel 210 are operated in the scattering inversion driving scheme, the data lines D1 to Dm may be driven in the charge share driving method.

Figure 24:
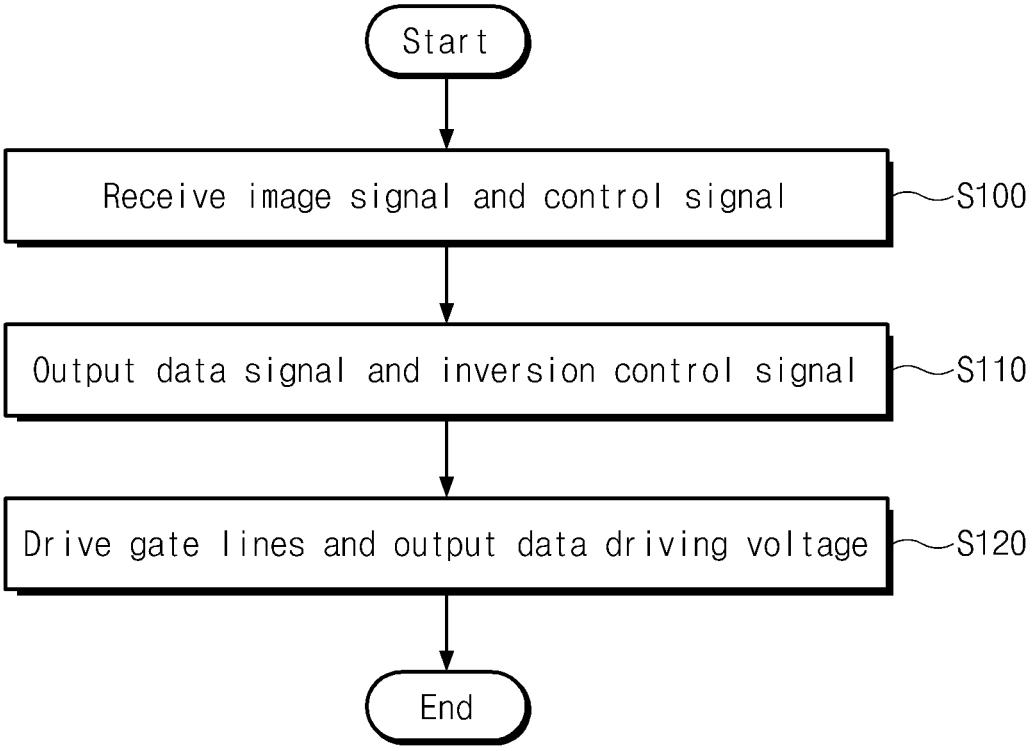
FIG. 24 is a flowchart explaining a method of driving a liquid crystal display according to an exemplary embodiment of the present invention.

FIG. 24 is a flowchart explaining a method of driving a liquid crystal display according to an exemplary embodiment of the present invention.

For the convenience of explanation, the method of driving the liquid crystal display will be described with reference to FIG. 1.

Referring to FIGS. 1 and 24, the timing controller 120 receives the image signal RGB and the control signal CTRL from the external source (not shown) (S100). The timing controller 120 outputs the inversion control signal REV, the data signal DATA, the first control signal CONT1, and the second control signal CONT2 in response to the image signal RGB and the control signal CTRL (S110).

The data driver 130 outputs the data driving voltages to drive the data lines D1 to Dm in response to the inversion control signal REV, the data signal DATA, and the first control signal CONT1 from the timing controller 120 (S120). The gate driver 150 sequentially drives the gate lines G1 to Gn in response to the second control signal CONT2 from the timing controller 120 (S120).

In the present exemplary embodiment, the inversion control signal REV includes the inversion information corresponding to each of the pixels and the inversion information is repeated at every inversion block including I by J pixels (I and J are positive integers) and at every K frame (K is a positive integer). The inversion information indicates the polarity of each of the m by n pixels that is operated in a positive (+) or negative (−) polarity. The inversion control signal REV is the same as described with reference to FIGS. 10 to 17.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A liquid crystal display comprising:

a plurality of pixels arranged in areas defined by a plurality of gate lines and a plurality of data lines;

a gate driver configured to drive the gate lines;

a data driver configured to drive the data lines in response to an inversion control signal; and a timing controller configured to control the gate driver and the data driver in response to an image signal and a control signal from an external source, wherein:

the inversion control signal carries inversion information that indicates a polarity of each of the pixels that is operated in a positive or negative polarity;

the inversion information is repeated at every inversion block comprising I by J pixels and at every K frame, I, J, and K each being a positive integer;

the timing controller is further configured to output a data signal and a data latch signal; and the data driver is further configured to convert the data signal to a data driving voltage to drive the data lines in response to the data latch signal and the inversion control signal.

2. The liquid crystal display of claim 1, wherein the inversion block comprises the pixels respectively connected to I gate lines and respectively connected to J data lines.

3. The liquid crystal display of claim 2, wherein the inversion control signal corresponding to the inversion block comprising the I by J pixels comprises I by J pieces of inversion information.

4. The liquid crystal display of claim 2, wherein the I by J pieces of inversion information corresponding to the inversion block comprising the I by J pixels are different from each other during successive K frames.

5. The liquid crystal display of claim 1, wherein the data latch signal has a frequency substantially the same as a frequency of the inversion control signal.

6. The liquid crystal display of claim 1, wherein the timing controller is further configured to output a charge share signal, the data driver comprises a plurality of switches respectively corresponding to the data lines, and each of the switches is connected between the data line and the charge share voltage and operated in response to the charge share signal.

7. The liquid crystal display of claim 6, wherein the charge share voltage has a level of a common voltage.

8. A method of driving a liquid crystal display comprising a plurality of pixels arranged in areas defined by a plurality of gate lines and a plurality of data lines, the method comprising:

receiving an image signal and a control signal to output a data signal, a data latch signal, and an inversion control signal; and outputting a data driving voltage to drive the data lines in response to the data signal and the inversion control signal, wherein:

the inversion control signal carries inversion information corresponding to each of the pixels, and the inversion information is repeated at every inversion block comprising I by J pixels and at every K frame, I, J, and K each being a positive integer; and the outputting of the data driving voltage comprises converting the data signal to the data driving voltage in response to the data latch signal and the inversion control signal.

9. The method of claim 8, wherein the inversion control signal carries the inversion information that indicates a polarity of each of the pixels that is operated in a positive or negative polarity.

10. The method of claim 9, wherein the inversion block comprises the pixels respectively connected to I gate lines and respectively connected to J data lines, and the inversion control signal corresponding to the inversion block comprising the I by J pixels comprises I by J pieces of inversion information.

11. The method of claim 10, wherein the I by J pieces of inversion information corresponding to the inversion block comprising the I by J pixels are different from each other during successive K frames.

12. The method of claim 8, further comprising outputting a data signal and a data latch signal in response to the image signal and the control signal.

13. The method of claim 8, wherein the data latch signal has a frequency substantially same as a frequency of the inversion control signal.

14. The method of claim 8, further comprising:

outputting a charge share signal in response to the control signal; and setting the data lines to a charge share voltage in response to the charge share signal.

15. The method of claim 14, wherein the charge share voltage has a level of a common voltage.

* * * * *